US006717352B2

(12) United States Patent
Hirasawa et al.

(10) Patent No.: US 6,717,352 B2
(45) Date of Patent: Apr. 6, 2004

(54) DISPLAY DEVICE

(75) Inventors: Shigemi Hirasawa, Chiba (JP); Kenji Miyata, Hitachinaka (JP); Tomio Yaguchi, Sagamihara (JP); Yuuichi Kijima, Chousei (JP); Hiroshi Kawasaki, Ooamishirasato (JP)

(73) Assignees: Hitachi, Ltd., Tokyo (JP); Hitachi Device Engineering Co., Ltd., Chiba-ken (JP)

( * ) Notice: Subject to any disclaimer, the term of this patent is extended or adjusted under 35 U.S.C. 154(b) by 38 days.

(21) Appl. No.: 10/119,368

(22) Filed: Apr. 9, 2002

(65) Prior Publication Data

US 2002/0167266 A1 Nov. 14, 2002

(30) Foreign Application Priority Data

May 9, 2001 (JP) ..... 2001-139038

(51) Int. Cl.[7] ..... H01J 1/62
(52) U.S. Cl. ..... 313/496; 315/169.3; 313/495
(58) Field of Search ..... 315/169.1, 169.3, 315/366; 313/409, 415, 421, 495, 512, 422, 496; 345/74, 75

(56) References Cited

U.S. PATENT DOCUMENTS

| | | | | |
|---|---|---|---|---|
| 3,453,478 A | | 7/1969 | Shoulders | 313/309 |
| 5,160,871 A | * | 11/1992 | Tomii et al. | 315/366 |
| 5,270,617 A | * | 12/1993 | Nonomura et al. | 31/169.1 |
| 5,773,834 A | | 6/1998 | Yamamoto et al. | 250/423 F |
| 6,208,072 B1 | | 3/2001 | Watanabe et al. | 313/697 |
| 6,236,381 B1 | * | 5/2001 | Kurata et al. | 345/74.1 |
| 6,420,825 B1 | * | 7/2002 | Shinjo et al. | 313/495 |
| 6,459,207 B1 | * | 10/2002 | Nomura et al. | 315/169.3 |

FOREIGN PATENT DOCUMENTS

| | | |
|---|---|---|
| JP | 9-221309 | 8/1997 |
| JP | 11- 144652 | 5/1999 |
| JP | 2000-21305 | 1/2000 |
| JP | 2000-251783 | 9/2000 |
| JP | 2000-323078 | 11/2000 |
| JP | 2001-23550 | 1/2001 |
| JP | 2001-043791 | 2/2001 |
| JP | 2001-035347 | 9/2001 |

* cited by examiner

*Primary Examiner*—Don Wong
*Assistant Examiner*—Jimmy T. Vu

(57) ABSTRACT

A gap defined between cathode wires 2 having electron emitting sources 2*a* and control electrodes 4 is made uniform and a thickness of an insulation layer 3 interposed between both of them is made thin or the insulation layer 3 is eliminated whereby the electron emission characteristics and the high-frequency driving of high performance can be realized. The control electrodes 4 which have recessed portions 4*c* in plate-like members and have holes 4*a* for allowing electrons to pass therethrough in bottom portions thereof restrict the gap defined between the cathode wires 2 and the control electrodes 4 by adjusting a plate-thickness direction size of the holes 4*a* formed in the control electrodes 4.

19 Claims, 24 Drawing Sheets

DISPLAY DEVICE

BACKGROUND OF THE INVENTION

The present invention relates to a display device which utilizes an emission of electrons into a vacuum, and more particularly, to a display device which can enhance the display characteristics by enabling the stable control of an electron emission quantity by forming a gap between electron emitting sources and control electrodes which controls the electron emission quantity from the electron emitting sources with high accuracy.

As a display device which exhibits the high brightness and the high definition, color cathode ray tubes have been widely used conventionally. However, along with the recent request for the higher quality of images of information processing equipment or television broadcasting, the demand for planar displays (panel displays) which are light in weight and require a small space while exhibiting the high brightness and the high definition has been increasing.

As typical examples, liquid crystal display devices, plasma display devices and the like have been put into practice. Further, particularly, as display devices which realize the higher brightness, it is expected that various kinds of panel-type display devices including a display device which utilizes an emission of electrons from electron emitting sources into a vacuum (hereinafter, referred to as "an electron emission type display device" or "a field emission type display device") and an organic EL display which is characterized by low power consumption will be commercialized.

Among such panel type display devices, as the above-mentioned field emission type display device, a display device having an electron emission structure which was invented by C. A. Spindt et al (for example, see U.S. Pat. No. 3,453,478, Japanese Patent Laid-open No. 2000-21305), a display device having an electron emission structure of a metal-insulator-metal (MIM) type, a display device having an electron emission structure which utilizes an electron emission phenomenon based on a quantum theory tunnelling effect (also referred to as "surface conduction type electron emitting source, see Japanese Patent Laid-open No. 2000-21305), and a display device which utilizes an electron emission phenomenon having a diamond film, a graphite film and a carbon nanotube and the like have been known.

FIG. 29 is a cross-sectional view for explaining one constitutional example of a known field emission type display device, and FIG. 30A to FIG. 30B are explanatory views showing constitutional examples of an electron emission source of one pixel and a control electrode which controls an electron emission quantity from the electron emission source. The field emission type display device is constituted such that a sealing frame 300 is interposed and sealed between both inner peripheries of a rear panel 100 which forms field-emission type electron emitting sources 2*a* and control electrodes 4 over an inner surface thereof and a face panel 200 which form anodes 7 and a fluorescent material layer 6 on an inner surface thereof which faces the above-mentioned rear panel 100, and the inside which is defined by the rear panel 100, the face panel 200 and the sealing frame 300 is reduced to a pressure lower than an atmospheric pressure of an external field or is evacuated (hereinafter referred to as "vacuum").

The rear panel 100 includes cathode wires 2 which have electron emitting sources 2*a* and the control electrodes 4 which are formed such that the control electrodes 4 cross the cathode wires 2 by way of an insulation layer 3 on the rear substrate 1 preferably made of glass or alumina or the like. Then, an electron emission quantity (including turning on or off of emission) from the electron emitting sources 2*a* are controlled in response to the potential difference between the cathode wires 2 and the control electrodes 4.

Further, the face panel 200 includes the anodes 7 and the fluorescent material layer 6 on a face substrate 5 formed of light-transmitting material such as glass. The sealing frame 300 is fixedly secured to the inner peripheries of the rear panel 100 and the face panel 200 using an adhesive such as frit glass. The inside defined by the rear panel 100, the face panel 200 and the sealing frame 300 is evacuated to a vacuum of $10^{-5}$ to $10^{-7}$ Torr, for example. A gap formed between the rear panel 100 and the face panel 200 is held by gap holding members 9.

The insulation layer 3 is interposed between the cathode wires 2 formed on the rear panel 100 and the control electrode 4 which cross the cathode wires 2 and an hole (grid hole) 4*a* is formed at each crossing portion of the cathode wire 2 and the control electrode 4. The hole 4*a* allows electrons emitted from the electron emitting source 2*a* to pass therethrough toward the anode side. On the other hand, the electron emitting source 2*a* is formed on the above-mentioned crossing portion of the cathode wire 2 and the control electrode 4 and an insulation layer 3 is eliminated at a portion which corresponds to the hole 4*a* of the control electrode 4. The above-mentioned electron emitting sources 2*a* are constituted of carbon nanotubes (CNT), diamond-like carbon (DLC) or other field emission cathode, for example.

Here, as the electron emitting sources 2*a*, light sources which use carbon nanotubes are illustrated. As shown in FIG. 30A and FIG. 30B, the electron emitting source 2*a* is formed right below the hole 4*a* of the control electrode 4. Although the case in which one electron emitting source 2*a* is formed per one pixel is illustrated in FIG. 30A and FIG. 30B, a plurality of electron emitting sources 2*a* may be formed per one pixel.

FIG. 31A and FIG. 31B are explanatory views corresponding to FIG. 30A to FIG. 30B which show a display device forming a plurality of electron emitting sources per one pixel. Here, a plurality of holes 4*a* are formed in the control electrode 4 and a plurality of electron emitting sources 2*a* are arranged on a cathode wire 2 corresponding to respective holes 4*a*.

Electrons emitted from a rear panel 100 impinge on a fluorescent material layer 6 of an opposing face panel 200. Light which corresponds to the emitting characteristics of the fluorescent material layer 6 is irradiated to the outside of the face panel 200 and functions as a display device.

As literatures which disclose the conventional technique related to this type of display device, for example, Japanese Patent Laid-open No. 1999-144652, Japanese Patent Laid-open No. 2000-323078 and the like are named.

However, the display devices which have been explained in conjunction with FIG. 30A, FIG. 30B and FIG. 31A, FIG. 31B have following problems.

FIG. 32 is an enlarged cross-sectional view of one pixel portion for explaining a constitutional example of a rear panel of a conventional field emission type display device. In such a display device of this type, with respect to a rear panel 100, cathode wires 2 are formed on a rear substrate 1 by a thin film patterning technique, an insulation layer 3 having a given thickness is formed on the cathode wires 2, and the insulation layer 3 corresponding to pixel portions are removed. Then, control electrodes 4 are formed on the insulation layer 3 by a vapor deposition method or a sputtering method except for holes 4*a*.

Since the insulation layer 3 is formed by coating resin material using a screen printing method, it is difficult to make a thickness of the insulation layer 3 uniform. Accordingly, it is impossible to obtain the uniform thickness with no irregularities over the entire surface of the display region. Since the control electrodes 4 are formed along the surface contour of the insulation layer 3, as emphasized in conjunction with FIG. 32, the irregularities are generated with respect to a gap defined between the cathode wires 2 and the control electrodes 4 due to the irregularities of the thickness of the insulation layer 3. It is necessary to control the gap between the cathode wires 2 and the control electrode 4 at a $\mu$m level because the irregularities of the gap in the peripheries of the holes 4*a* of the control electrode 4 bring about the irregularities of electron emission abilities of individual pixels.

Further, since the insulation layer 3 is disposed between the crossing portions of the cathode wires 2 and the control electrodes 4, the capacitance is generated. The irregularities of the thickness of the insulation layer 3 lead to the irregularities of the capacitance and when the thickness of the insulation layer 3 is increased, this obstructs the high-frequency driving. Accordingly, the thinner the thickness of the insulation layer 3, the high-frequency driving is improved and hence, it is ultimately desirable to have the constitution which can eliminate the insulation layer 3. The conventional technique is less than optimal with respect to these matters in using the display device in an actual use and these matters constitute drawbacks to be solved.

Accordingly, it is an object of the present invention to provide a display device which can solve the above-mentioned problems of the conventional techniques and can realize the electron emission characteristics and the high-frequency driving of high performance by adopting a constitution in which a gap formed between cathode wires 2 (electron emitting sources 2*a*) and control electrodes 4 can be made uniform and a thickness of an insulation layer 3 disposed between them can be reduced or the insulation layer 3 can be eliminated.

SUMMARY OF THE INVENTION

To achieve the above-mentioned object, a display device according to the present invention constitutes control electrodes by forming recessed portions and holes in plate-like members and regulates a gap between cathode wires and control electrodes based on a plate-thickness-direction size of the holes.

Further, the reduction of capacitance is achieved by making portions of the control electrodes face the rear substrate directly or by interposing an insulation layer between the control electrodes and the cathode wires. Further, projecting portions or thin plate-thickness portions such as recessed portions are formed by etching or the like at hole portions of the control electrodes or portions of the control electrodes except for the hole portions or a distance between holes through which the flow of electrons passes and the cathode wires is controlled. To describe the fundamental constitutions of the present invention, they are as follows.

(1) In a display device comprising a rear panel having a plurality of cathode wires having electron emitting sources, a plurality of control electrodes which cross the cathode wires and control an emission quantity of electrons from the electron emitting sources in response to the potential difference between the cathode wires and the control electrodes and a rear substrate, and a face panel having anodes and fluorescent materials, the control electrodes are formed of plate-like members, the control electrodes have holes which allow the electrons emitted from the electron emitting sources to pass therethrough toward the face panel side in first regions which cross the cathode wires, and assuming a distance from the rear substrate to the holes of the control electrodes as "a" and a distance from the rear substrate to the control electrodes as "b", the control electrodes have second regions where a relationship a>b is established between the neighboring cathode wires.

The above-mentioned first regions correspond to pixel portions. Recessed portions including holes are formed by etching cathode-wire sides of the control electrodes and projecting portions (second regions) which project toward a rear substrate side remain between the neighboring recessed portions. A distance between the control electrodes and the cathode wires, that is, a gap is formed based on the distance "a" from the rear substrate to the holes formed in the recessed portions. The gap is determined by a depth of etching and the gap which is the distance between the cathode wires and the control electrodes can be made uniform by forming recessed portions in the control electrodes by a uniform etching. Further, with the provision of the projecting portions, the insulation layer can be made thin or can be eliminated.

(2) In the constitution (1), the control electrodes are supported at the second regions.

(3) In the constitution (1) or (2), the control electrodes have recessed portions at the anode side in the first regions.

(4) In any one of the constitutions (1) to (3), an insulation layer is formed between the second regions and the rear substrate. By interposing the insulation layer between the portions of the control electrodes in which the recessed portions are not formed and the rear substrate, the gap adjustment and the electric insulation between the control electrodes and the cathode wires adjacent to the control electrodes can be ensured.

(5) In any one of the constitutions (1) to (4), the cathode wires are divided into two or more regions within one pixel and the control electrodes include the second region in each region defined between the divided cathode wires. In the constitution which divides one pixel, the portions projecting in the direction toward the rear substrate are formed between the divided portions in the same manner as portions formed between the neighboring pixels.

(6) In any one of the constitutions (1) to (5), the cathode wire includes an opening within one pixel and the control electrode has the second regions in the opening of the cathode wire. The projecting portions of the control electrodes are brought into contact with the rear substrate through the opening of the cathode wires.

(7) In any one of constitutions (1) to (6), the control electrodes are fixed to the rear panel by on adhesive. The control electrodes are formed by forming holes which allow electrons to pass therethrough and the recessed portions in metal material by etching and the control electrodes have both end peripheries thereof fixed to the rear substrate using an adhesive in the state that a tension is applied to the control electrodes in the longitudinal direction at the time of mounting the control electrodes to the rear substrate. Alternatively, the projecting portions of the control electrodes are fixed to the rear panel by an adhesive. Accordingly, the gap formed between the cathode wires and the control electrodes can be held uniform. The cathode wires can be fixed to the rear substrate by an anodic bonding.

(8) In any one of constitutions (1) to (7), the control electrode has the plurality of holes in one of the first regions. By arranging a plurality of electron emitting sources per one pixel, the uniform electron emission can be obtained.

(9) In the constitution (8), in one of the first regions, no insulation layer is provided between regions formed between the plurality of holes and the cathode wire. Since no insulation layer is provided between them, the capacitance between both electrodes can be reduced so that the display device is suitable for high-frequency driving.

(10) In a display device comprising a rear panel having a plurality of cathode wires having electron emitting sources, a plurality of control electrodes which cross the cathode wires and control an emission quantity of electrons from the electron emitting sources in response to the potential difference between the cathode wires and the control electrodes and a rear substrate, and a face panel having anodes and fluorescent materials, the control electrodes are formed of plate-like members, the control electrodes have third regions which are indented than other regions of the control electrodes in the thickness direction at positions where at least portions of the third regions are superposed on first regions where the control electrodes cross the cathode wires, and the control electrodes have holes which allow the electrons emitted from the electron emitting sources to pass therethrough in the first regions as well as in the third regions.

By forming the holes in the indentations, fine holes can be formed with high accuracy even when the thick plate-like member is used. Further, with the use of the plate-like member, the irregularities of the gap can be suppressed.

(11) In the constitution (10), assuming a distance from the rear substrate to the holes of the control electrodes as "a" and a distance from the rear substrate to the control electrodes as "b", the control electrodes have second regions where a relationship a>b is established between the neighboring cathode wires.

The control electrodes include the indentations at the cathode-wire side and have the projecting portions as the second regions and hence, the insulation layers can be made thin or can be eliminated.

(12) In the constitution (10) or (11), in the first regions, distances from the cathode wires to the first regions of the control electrodes are set substantially equal. This includes a case in which the indentations are formed at the anode side, a case in which the indentations are formed at the cathode wire side and over the whole first region, and a case in which both of these cases are combined.

(13) In the constitution (10) or (11), an insulation layer is formed between the cathode wires and the control electrodes in the first regions. By interposing the insulation layer between portions of the control electrodes where no indentations are formed and the cathode wires, the electric insulation between the cathode wires and the control electrodes is ensured.

(14) In the constitution (10) or (11), a thickness of widthwise end portions of the control electrodes is greater than a thickness of the holes in the first regions. The indentations are formed while except for the widthwise end portions.

(15) In the constitution (14), the insulation layer is disposed between the cathode wires and the control electrodes at the widthwise end portions in the first regions. The insulation between the cathode wires and the control electrodes can be ensured. Further, the control electrodes can be also supported by the insulation layers so that the control electrodes can be supported in a stable manner.

(16) In any one of the constitutions (10) to (15), the control electrodes include the plurality of holes in one of the first regions. By arranging a plurality of electron sources per one pixel, the uniform electron emission can be obtained.

(17) In any one the constitutions (10) to (16), the third regions are formed by etching. The control electrodes are formed by machining holes for allowing electrons to pass therethrough or indentations in a single plate-like member or a composite plate-like member by etching. Accordingly, the uniform holes or indentations can be formed in the thickness direction so that the irregularities of the gap between the cathode wires (electron emitting sources) and the control electrodes can be reduced.

(18) In a display device comprising a rear panel having a plurality of cathode wires having electron emitting sources, a plurality of control electrodes which cross the cathode wires and control an emission quantity of electrons from the electron emitting sources in response to the potential difference between the cathode wires and the control electrodes and a rear substrate, and a face panel having anodes and fluorescent materials, the control electrodes are formed of plate-like members and include a plurality of holes per one of first regions thereof which cross the cathode wires, and in one of the first regions, no insulation layer is disposed between regions formed between the plurality of holes and the cathode wires, and the cathode wires have the electron emitting sources having an area smaller than an area of the holes corresponding to the holes.

Since the area of the electron emitting sources is smaller than the area of the holes of the control electrodes, it is possible to make electrons emitted from the electron emitting sources pass in the anode direction without any loss so that images of high brightness can be obtained with low electric power consumption.

(19) In a display device comprising a rear panel having a plurality of cathode wires having electron emitting sources, a plurality of control electrodes which cross the cathode wires and control an emission quantity of electrons from the electron emitting sources in response to the potential difference between the cathode wires and the control electrodes and a rear substrate, and a face panel having anodes and fluorescent materials, the control electrodes are formed of plate-like members, the control electrodes include holes in regions thereof which cross the cathode wires, the control electrodes include projecting portions between the neighboring cathode wires, and the control electrodes are supported by the projecting portions. Accordingly, the control electrodes can be supported in a more stable manner.

Here, it is needless to say that the present invention is not limited to the above-mentioned constitutions and constitutions of embodiments which will be explained later and various modifications are conceivable without departing from the technical concept of the present invention.

BRIEF DESCRIPTION OF THE DRAWINGS

FIG. 4A and FIG. 4B are explanatory views showing the first embodiment which uses a control electrode shown in FIG. 3, wherein FIG. 4A is a layout view of a cathode wire and the control electrode mounted on the rear panel and FIG. 4B is a cross-sectional view taken along a line A–A' of FIG. 4A.

FIG. 6A and FIG. 6B are explanatory views of a third embodiment of a display device according to the present invention, wherein FIG. 6A is a plan view of an essential part of a rear panel and a FIG. 6B is a cross-sectional view taken along a line B–B' of FIG. 6A.

FIG. 7A and FIG. 7B are explanatory views of a fourth embodiment of a display device according to the present invention, wherein FIG. 7A is a plan view of an essential part of a rear panel and a FIG. 7B is a cross-sectional view taken along a line A–A' of FIG. 7A.

FIG. 8A to FIG. 8C are explanatory views of a fifth embodiment of a display device according to the present invention, wherein FIG. 8A is a plan view, FIG. 8B is a cross-sectional view taken along a line A–A' of FIG. 8A, and FIG. 8C is a cross-sectional view taken along a line B–B' of FIG. 8A.

FIG. 9A to FIG. 9C are explanatory views of a sixth embodiment of a display device according to the present invention, wherein FIG. 9A is a plan view, FIG. 9B is a cross-sectional view taken along a line A–A' of FIG. 9A, and FIG. 9C is a cross-sectional view taken along a line B–B' of FIG. 9A.

FIG. 10A to FIG. 10C are explanatory views of a seventh embodiment of a display device according to the present invention, wherein FIG. 10A is a plan view, FIG. 10B is a cross-sectional view taken along a line A–A' of FIG. 10A, and FIG. 10C is a cross-sectional view taken along a line B–B' of FIG. 10A.

FIG. 12A and FIG. 12B are explanatory views of the eighth embodiment of the display device according to the present invention which uses the control electrode shown in FIG. 11, wherein FIG. 12A is a plan view and FIG. 12B is a cross-sectional view taken along a line A–A' of FIG. 12A.

FIG. 13A to FIG. 13C are partial cross-sectional views for explaining a control electrode used in a ninth embodiment of the display device according to the present invention, wherein FIG. 13A is a plan view, FIG. 13B is a cross-sectional view taken along a line A–A' of FIG. 13A, and FIG. 13C is a cross-sectional view showing a modification of FIG. 13B.

FIG. 16A and FIG. 16B are explanatory views of an essential structure of FIG. 14, wherein FIG. 16A is a plan view as viewed in the I–J direction of FIG. 14 and FIG. 16B is a cross-sectional view taken along a line A–A' of FIG. 16A.

FIG. 21A and FIG. 21B are views for explaining the eleventh embodiment of the display device according to the present invention, wherein FIG. 21A is a plan view of an essential part similar to FIG. 16A and FIG. 21B is a cross-sectional view taken along a line E–F of FIG. 21A.

FIG. 22A and FIG. 22B are explanatory views of a twelfth embodiment of the display device according to the present invention, wherein FIG. 22A is a plan view of an essential part and FIG. 22B is a cross-sectional view taken along a line A–A' of FIG. 22A.

DESCRIPTION OF THE PREFERRED EMBODIMENTS

Preferred embodiments of the present invention are explained in detail hereinafter in conjunction with drawings which show these embodiments.

Figure 1:
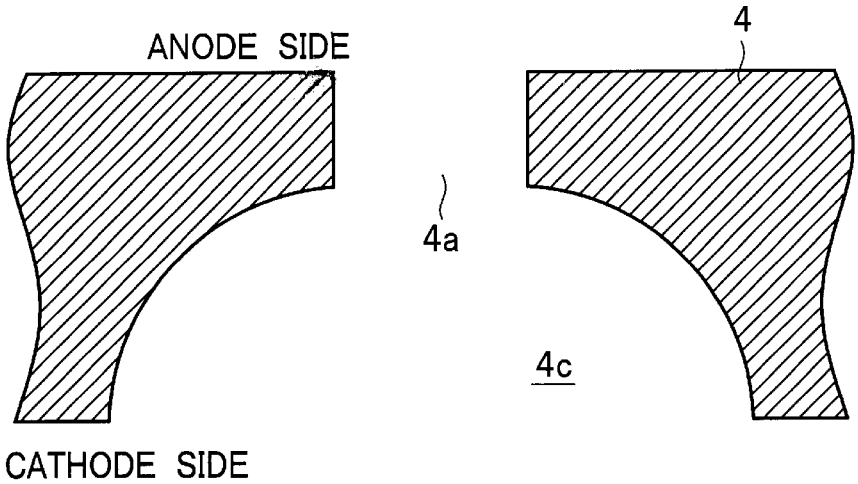
FIG. 1 is a partial cross-sectional view of a control electrode for explaining the fundamental constitution of a display device according to the present invention.

FIG. 1 is a partial cross-sectional view of a control electrode which is served for explaining a basic structure of a display device according to the present invention. Reference numeral 4 indicates control electrodes each of which is formed of a plate-like member. The control electrode 4 has a recessed portion 4*c* at a cathode wire side of a portion thereof corresponding to one pixel, wherein the recessed portion 4*c* is indented more than other portion of the control electrode 4 in the thickness direction. One hole 4*a* which allows electrons to pass therethrough is formed in a bottom portion, that is at an anode side of the control electrode 4. Although the control electrode 4 is preferably made of ferro-alloy (for example, 42%Ni—6%Cr—balance Fe), the control electrode 4 is not limited to this material.

The above-mentioned hole 4*a* and the recessed portion 4*c* are machined by etching. The etching is performed in two stages. That is, first of all, the recessed portion 4*c* is etched and thereafter, the hole 4*a* is etched. Accordingly, even when the plate is thick, the fine hole 4*a* can be formed with high accuracy. The formation of the hole 4*a* and the recessed portion 4*c* may be performed in an order opposite to the above-mentioned order. Both of the holes 4*a* and the recessed portions 4*c* are etched from the same one side or a side opposite from such one side. It is also possible to etch both of them from both surfaces simultaneously.

Figure 2:
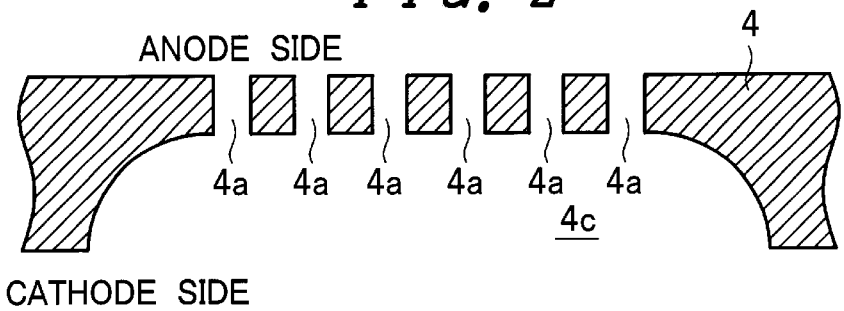
FIG. 2 is a partial cross-sectional view of a rear panel for explaining the fundamental constitution of a display device according to the present invention.

FIG. 2 is a partial cross-sectional view of a rear panel which is served for explaining the basic constitution of the display device according to the present invention. In such a constitution, a recessed portion 4*c* is formed at a cathode-wire side of a portion corresponding to one pixel and a plurality of holes 4*a* which allow electrons to pass therethrough are formed in a bottom portion, that is, an anode side of the rear panel. Since both parts shown in FIG. 1 and FIG. 2 are formed by machining plate-like members different from conventional control electrodes formed by a conventional spattering or the like, an advantageous effect that the parts can be manufactured as separate members can be obtained.

Figure 3:
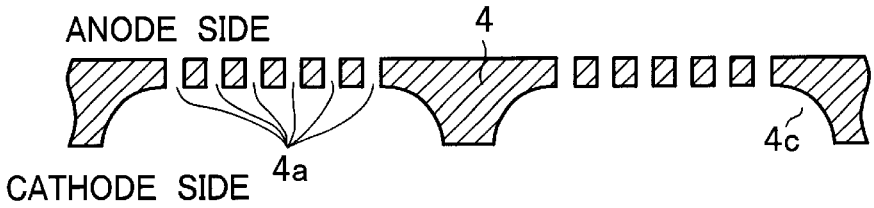
FIG. 3 is a cross-sectional view of a control electrode mounted on a rear panel for explaining a first embodiment of a display device according to the present invention.
Figure 4A:
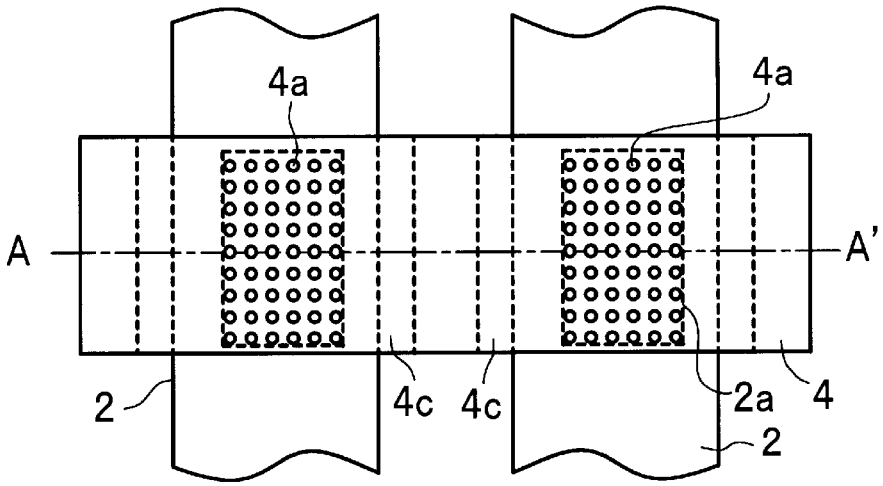
Figure 4B:
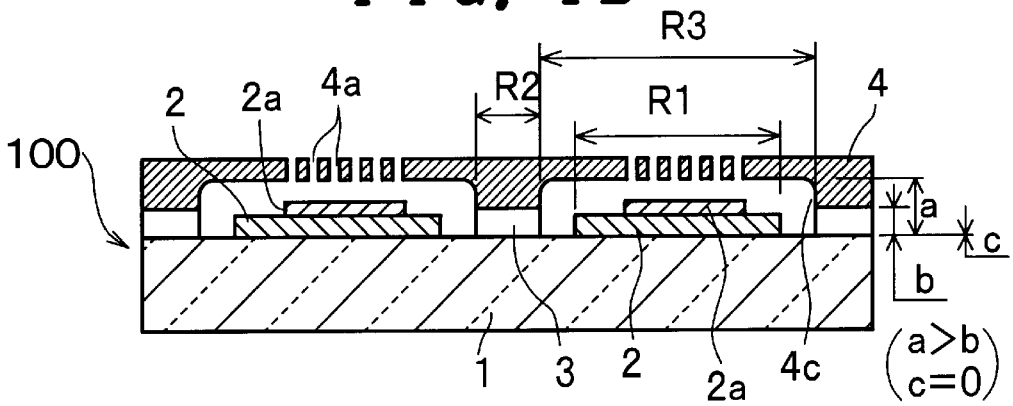

FIG. 3 is a cross-sectional view of a control electrode provided to the rear panel for explaining a first embodiment of the display device according to the present invention and FIG. 4 is an explanatory view of the first embodiment of the display device which uses the control electrode shown in FIG. 3. FIG. 3 shows the control electrode similar to the control electrode which was explained in conjunction with the above-mentioned FIG. 2 and shows the control electrode corresponding to two neighboring pixels. FIG. 4A is a layout view of cathode wires 2 and the control electrodes 4 provided to the rear panel and FIG. 4B is a cross-sectional view taken along a line A–A' of FIG. 4A.

As shown in FIG. 3, FIG. 4A and FIG. 4B, in this embodiment, the control electrode 4 includes recessed portions 4*c* each of which has a plurality of holes 4*a* and is opened to the cathode wire 2 side and an insulation layer 3 is interposed between a rear substrate 1 and the control electrode 4. The insulation layer 3 is positioned between a thick plate portion (projecting portion) arranged between the neighboring pixels and the rear substrate 1.

The cathode wires 2 are formed on the rear substrate 1 and electron emitting sources 2*a* are provided onto the cathode wires 2. The control electrode 4 controls the emission of electrons from the electron emitting sources 2*a* (including the turning on and off for emission) in response to the potential difference generated between the cathode wire 2 and the control electrode 4.

The control electrode 4 is a plate-like member formed of a single plate or a two-or-more-layered composite plate made of iron or alloy containing iron as a main component. In each first region R1 where the control electrode 4 crosses the cathode wire 2, the control electrode 4 has a plurality of holes 4*a* which allow electrons emitted from the electron emitting source 2*a* to pass therethrough to the face panel side.

Then, by assuming a distance from the rear substrate 1 to the holes 4*a* of the control electrode 4 as "a" and a distance from the rear substrate 1 to the control electrode 4 as "b", a second region R2 having a relationship a>b is formed between the neighboring cathode wires 2. When another layer such as a silica layer or the like is interposed between the rear substrate 1 and the cathode wires 2, assuming a thickness of another layer as "c", the thickness becomes c=0 since there exists no such a layer in FIG. 4B. Further, regions in which recessed portions 4*c* of the control electrodes 4 are formed are indicated as third regions R3.

In other words, the third region R3 which constitutes the recessed portion 4*c* is formed such that at least a portion of the third region R3 is superposed on the first region R1, the second region R2 which constitutes a projecting portion is formed between the neighboring cathode wires 2, and the control electrode 4 is supported in a spaced apart manner from the cathode wire 2 by the projecting portions which are brought into contact with an upper surface of the insulation layer 3.

The relationship among the first region R1, the second region R2 and the third region R3 is shown in FIG. 4B. In the second region R2, the insulation layer 3 is interposed between the rear substrate 1 and the control electrode 4 and the inside of the recessed portion 4*c* is evacuated. In this embodiment, the recessed portion 4*c* is formed such that the recessed portion 4*c* reaches the widthwise end peripheries of the control electrode 4. Accordingly, it is unnecessary to form the insulation layer 3 on regions where the control electrode 4 crosses the cathode wires 2 and hence, this embodiment is suitable for the high-frequency driving.

Further, the depth of the recessed portions 4*c* formed by etching can be accurately controlled compared to the irregularities of a thickness of the insulation layer 3 and hence, a gap formed between the cathode wires 2 (electron emitting sources 2*a*) and the holes 4*a* can be accurately controlled. Further, with the use of the control electrode 4 formed of a plate-like member, even when a large number of holes 4*a* are formed in an array in one pixel, it is unnecessary to provide the insulation layer 3 between the holes 4*a* in one pixel for supporting the control electrode 4 and hence, the embodiment is suitable for the high-frequency driving.

Still further, since the control electrode 4 is formed of the plate-like member, it is possible to obtain an advantageous effect that the gap is hardly influenced by the irregularities of the thickness of the insulation layer 3. Further, since the control electrode 4 is supported on the projecting portions, the thickness of the insulation layers 3 which are necessary for forming a given gap can be reduced and hence, the irregularities of the thickness can be also made small.

Figure 5A:
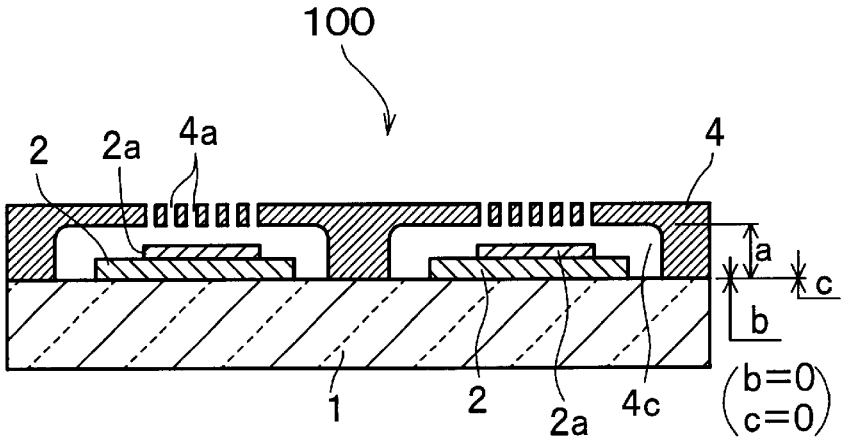
FIG. 5A and FIG. 5B are cross-sectional views similar to the cross-sectional view of FIG. 4B which explain a second embodiment of the display device according to the present invention.
Figure 5B:
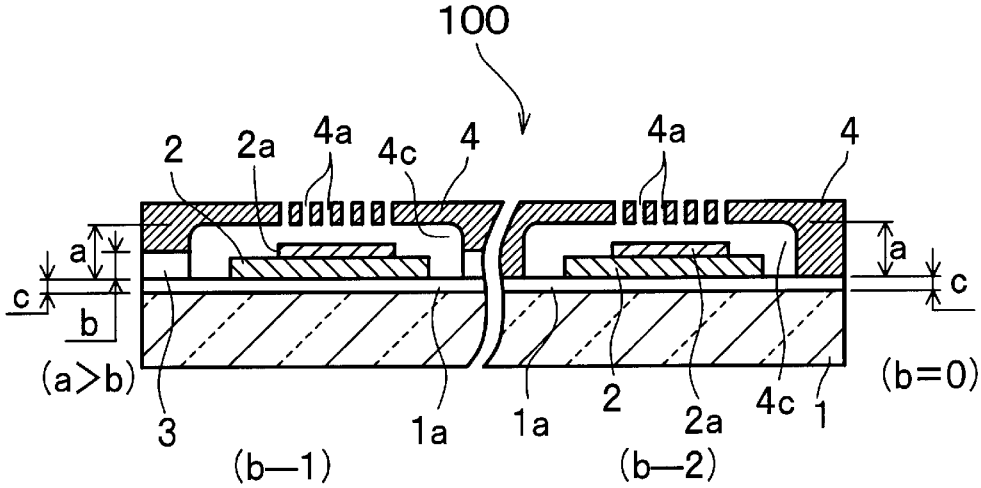

FIG. 5A and FIG. 5B are cross-sectional views similar to the cross-sectional view of FIG. 4B for explaining a second embodiment of the display device according to the present invention. In the embodiment shown in FIG. 5A, each thick plate portion which constitutes a projecting portion remaining between the recessed portions 4*c* is directly brought into contact with a rear substrate 1 so that it is unnecessary to provide an insulation layer 3 between the rear substrate 1 and the control electrode 4. Here, a distances "b" and a thickness "c" are respectively set to b=0, c=0. Due to such a constitution, the fabrication process can be simplified.

As shown in FIG. 5B, when a silica thin film 1*a* is formed on an inner surface of the rear substrate 1 in the first embodiment shown in FIG. 4B or in the embodiment shown in FIG. 5A, it may be possible to adopt a constitution (b-1) or a constitution (b-2) in FIG. 5B. In this case, it is considered that the rear substrate 1 includes the silica thin film 1*a* and the distances "a", "b" are measured from an upper surface of the silica thin film 1*a*. Distances "a", "b" and a thickness "c" are respectively set to a>b, c≠0 in the constitution (b-1) of FIG. 5B and a>b, b=0 in the constitution (b-2) of FIG. 5B.

Figure 6A:
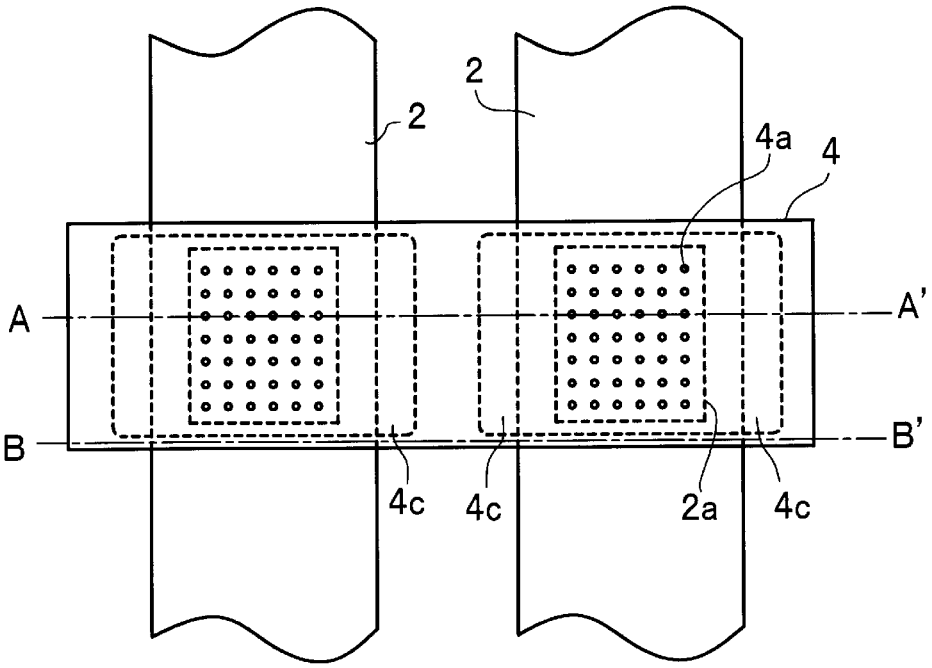
Figure 6B:
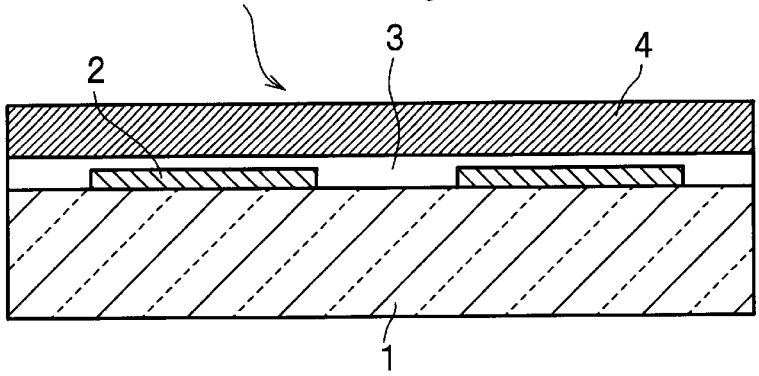

FIG. 6A and FIG. 6B are explanatory views of a third embodiment of a display device according to the present invention, wherein FIG. 6A is a plan view of an essential part of a rear panel and FIG. 6B is cross-sectional view taken along a line B–B' of FIG. 6A. Here, a cross section taken along a line A–A' of FIG. 6A is similar to the cross section of the above-mentioned FIG. 4B. In this embodiment, recessed portions 4*c* are formed while leaving both widthwise peripheries (widthwise end portions) of a control electrode 4. Other constitutions are similar to those of FIG. 4A and FIG. 4B.

Accordingly, as shown in FIG. 6B, it is necessary to form an insulation layer 3 around the above-mentioned recessed portions 4*c* at crossing portions between a control electrode 4 and cathode wires 2. However, in this embodiment, since the width of the insulation layer 3 which is interposed between the control electrode 4 and the cathode wires 2 is narrow, the embodiment is suitable for the high-frequency driving. Further, since supports formed of the insulation layer 3 are also provided to the crossing portions, a gap formed between the control electrode 4 and the cathode wires 2 can be surely maintained.

Figure 7A:
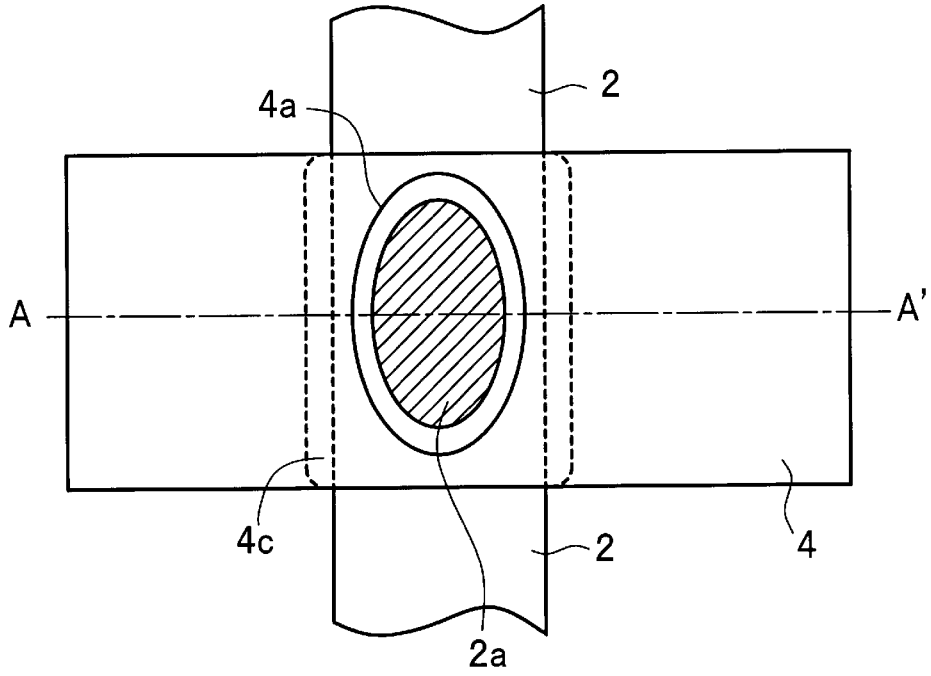
Figure 7B:
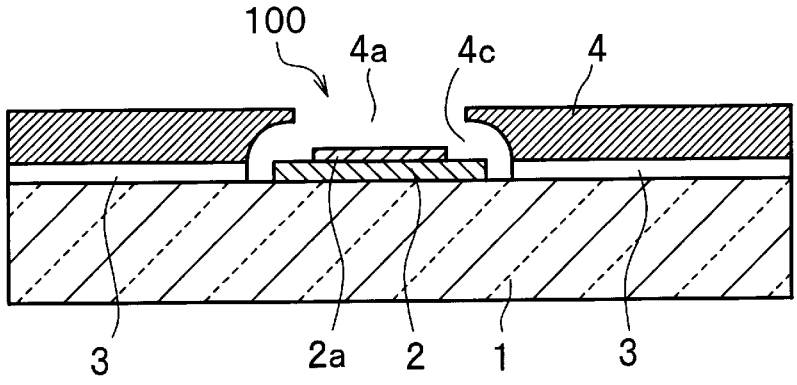

FIG. 7A and FIG. 7B are explanatory views of a fourth embodiment of the display device according to the present invention, wherein FIG. 7A is a plan view of an essential part of a rear panel and FIG. 7B is a cross-sectional view taken along a line A14 A' of FIG. 7A. In this embodiment, a recessed portion 4*c* is formed such that the recessed portion 4*c* is extended to both widthwise end peripheries (widthwise end portions) of a control electrode 4, a large single hole 4*a* having an elliptical shape is formed in the control electrode 4, and an electron emitting source 2*a* which is slightly smaller than the above-mentioned hole 4*a* is formed on a cathode wire 2.

Due to such a constitution of this embodiment, electrons of high density can be taken out and, at the same time, electrons of high density can be taken out also in the arrangement direction of the control electrode 4 so that a display of high brightness can be achieved.

Figure 8A:
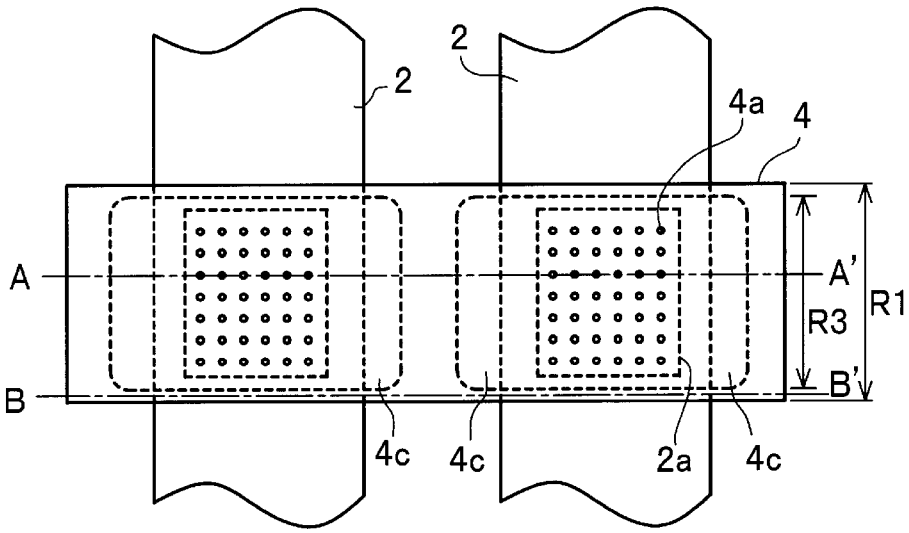
Figure 8B:
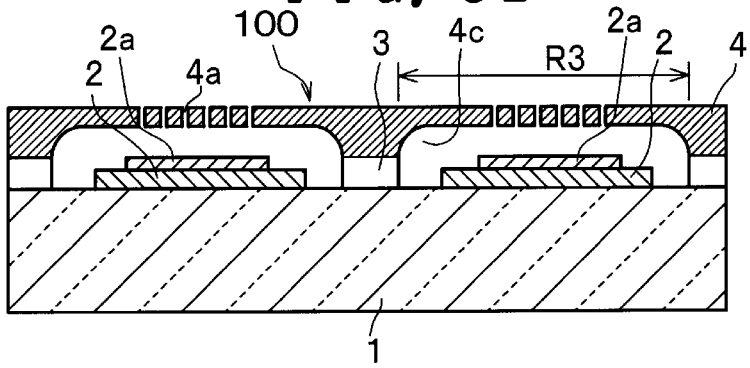
Figure 8C:
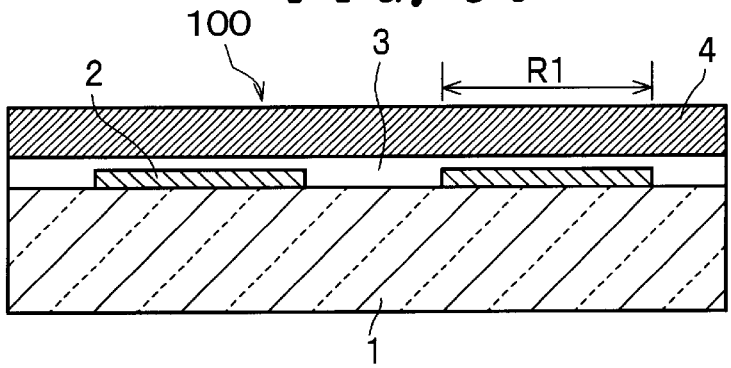

FIG. 8A to FIG. 8C are explanatory views of a fifth embodiment of the display device according to the present invention, wherein FIG. 8A is a plan view, FIG. 8B is a cross-sectional view taken along a line A–A' of FIG. 8A, and FIG. 8C is a cross-sectional view taken along a line B–B' of FIG. 8A. In this embodiment, an insulation layer 3 is interposed also at crossing portions between control electrodes 4 and cathode wires 2 by narrowing a width of the recessed portion 4*c* formed in the control electrode 4 in the first embodiment explained in conjunction with the above-mentioned FIG. 4A and FIG. 4B than a width of the control electrode 4. According to such a constitution, this embodiment can achieve the advantageous effect of the above-mentioned first embodiment and the advantageous effect of the third embodiment explained in conjunction with FIG. 6A and FIG. 6B.

Figure 9A:
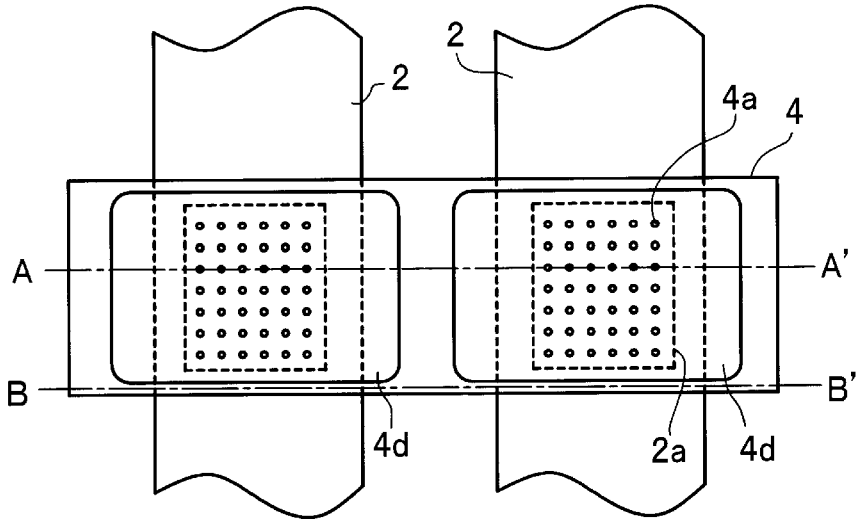
Figure 9B:
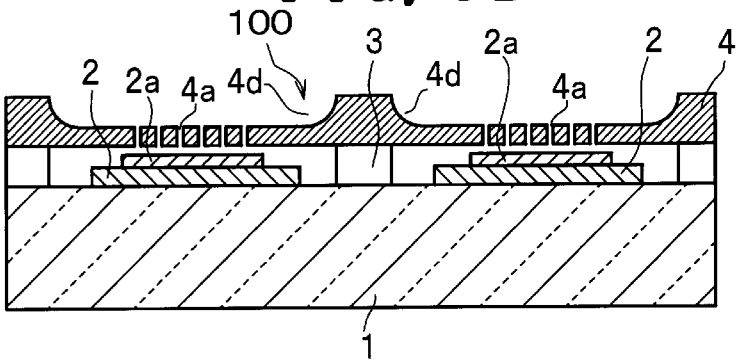
Figure 9C:
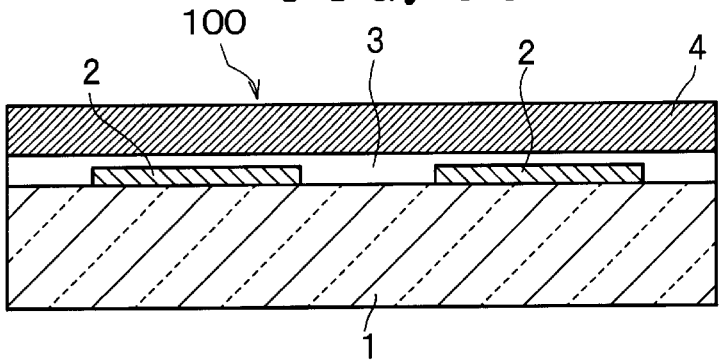

FIG. 9A to FIG. 9C are explanatory views of a sixth embodiment of the display device according to the present invention, wherein FIG. 9A is a plan view, FIG. 9B is a cross-sectional view taken along a line A–A' of FIG. 9A, and FIG. 9C is a cross-sectional view taken along a line B–B' of FIG. 9A. In this embodiment, recessed portions which are formed in a control electrode 4 are formed at an anode side and the recessed portions which are formed at the anode side are indicated by reference numeral 4*d*. A plurality of holes 4*a* which allow electrons to pass therethrough to the anode side are formed in a bottom portion of each recessed portion 4*d* in the same manner as the above-mentioned embodiments. Then, an insulation layer 3 is interposed between the rear substrate 1 and the control electrode 4 so as to restrict a gap defined between the control electrode 4 and the cathode wires 2 (electron emitting source 2*a*).

According to this embodiment, a surface of the control electrode 4 which faces the rear substrate 1 constitutes a surface which is not subjected to an etching treatment and hence, the surface is flat whereby even when some irregularities are present with respect to a thickness of the insulation layer 3, the irregularities is not generated with respect to the above-mentioned gap in many cases so that it is possible to increase a plate thickness of the control electrode 4. Further, even when the plate thickness is increased, the holes 4*a* are formed in the recessed portion 4*d* and hence, an advantageous effect that the holes 4*a* can be formed with high accuracy is obtained. Further, since the insulation layer 3 is not necessary (or can be reduced) in the pixel, a capacitance reduction effect can be also obtained. Here, although the insulation layer 3 is formed only at positions corresponding to widthwise end portions of the control electrode 4 in the pixel in FIG. 9C, the insulation layer 3 may be eliminated from the inside of the pixel by forming the control electrode 4 in the same manner as FIG. 9B.

Figure 10A:
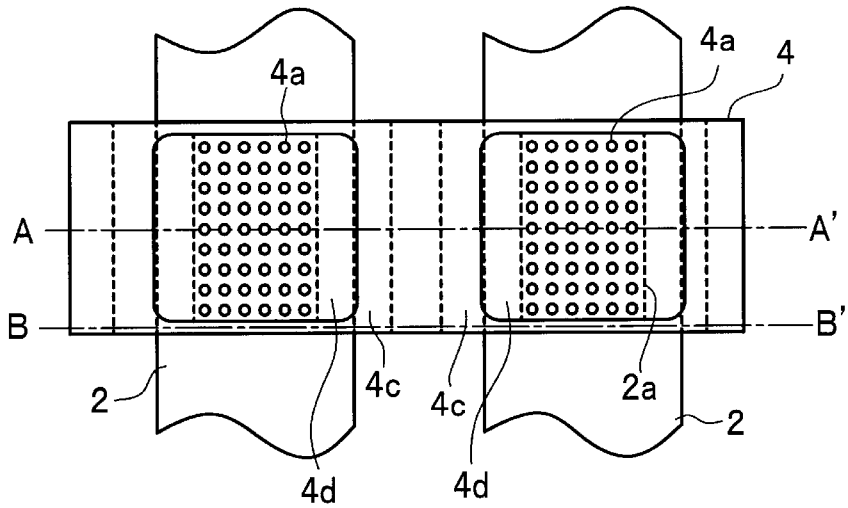
Figure 10B:
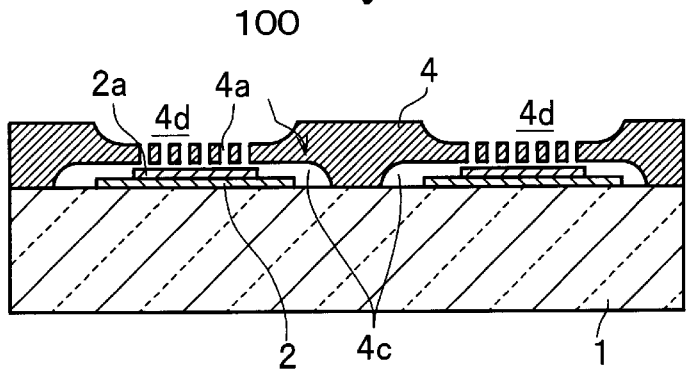
Figure 10C:
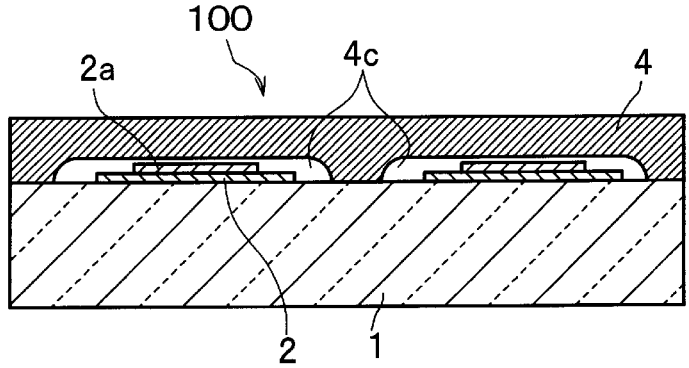

FIG. 10A to FIG. 10C are explanatory views of a seventh embodiment of the display device according to the present invention, wherein FIG. 10A is a plan view, FIG. 10B is a cross-sectional view taken along a line A–A' of FIG. 10A, and FIG. 10C is a cross-sectional view taken along a line B–B' of FIG. 10A. In this embodiment, along with the formation of the recessed portions 4*c* at the cathode wire 2 side in respective embodiments explained in conjunction with the above-mentioned FIG. 1 to FIG. 8, the recessed portions 4*d* at the anode side in the sixth embodiment explained in conjunction with the above-mentioned FIG. 9A to FIG. 9C are formed.

The cathode-side recessed portions 4*c* are formed such that the recessed portions 4*c* are extended to both widthwise end peripheries (widthwise end portions) of the control electrode 4. Further, the anode-side recessed portions 4*d* are formed such that the recessed portions 4*d* are disposed at the inside of the above-mentioned cathode-side recessed portions 4*c*. That is, the anode-side recessed portions 4*d* are framed as a whole.

Due to such a constitution, even when a plate-thickness of the control electrode 4 is reduced, the control unit electrode 4 can maintain the strength thereof as a whole and hence, the biased elongation generated by applying a tension at the time of assembling can be prevented. In the above-mentioned respective embodiments, the etching processing is performed only on one-side surface of the control electrode 4 so that there may be a case in which the change of the gap between the control electrode 4 and the cathode wires 2 cannot be completely suppressed due to the deformation of the control electrode 4 derived from the residual strain. By performing the etching processing on both surfaces of the control electrode as in the case of this embodiment, the above-mentioned change of the gap derived from the residual strain can be suppressed. Here, this embodiment may be combined with other embodiments, wherein this embodiment may be provided with an insulation layer 3 or the recessed portions 4*c* may be formed except for the widthwise end portions. Further, the anode-side recessed portions 4*d* are formed such that the recessed portions 4*d* are extended to the widthwise end portions. Also with respect to electron emitting sources 2*a*, it is not necessary to form the electron emitting sources 2*a* at positions taken along a line B–B' of FIG. 10A.

Figure 11:
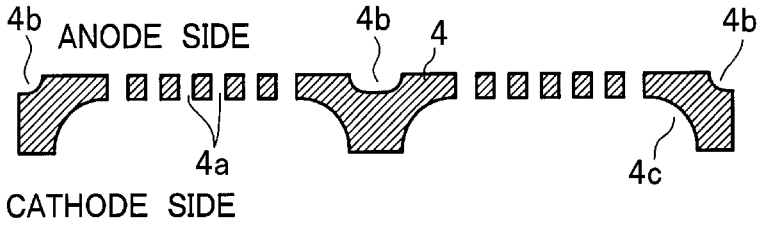
FIG. 11 is a partial cross-sectional view for explaining a control electrode used in an eighth embodiment of the display device according to the present invention.
Figure 12A:
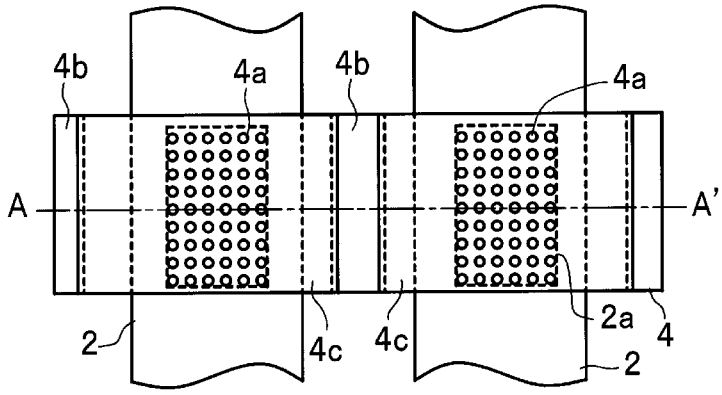
Figure 12B:
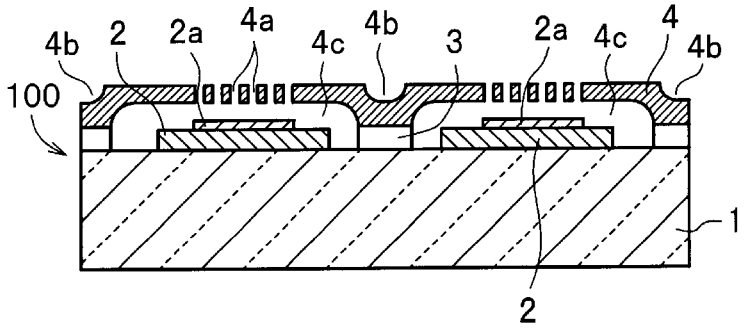

FIG. 11 is a partial cross-sectional view for explaining a control electrode used in an eighth embodiment of the display device according to the present invention. Further, FIG. 12 is an explanatory view of this embodiment which uses the control electrode shown in FIG. 11, wherein FIG. 12A is a plan view and FIG. 12B is a cross-sectional view taken along a line A–A' of FIG. 12A. In this embodiment, so-called half-etched portions 4*b* are formed on an anode-side of a control electrode 4 at each position located between pixels (between cathode wires 2). Here, the half-etched portions 4*b* may be formed at a cathode wire 2 side of the control electrode 4.

A width of the half-etched portions 4*b* is determined corresponding to a plate thickness of the control electrode 4 and a depth and a size of a cathode-wire-2-side recessed portion 4*c* such that both surfaces of the control electrode 4 are balanced. According to this embodiment, it is possible to suppress a phenomenon that when a tension is applied to the control electrode 4 in the longitudinal direction thereof at the time of assembling, particularly, a portion of the control electrode 4 in which holes 4*a* are formed is unevenly elongated.

Here, although the recessed portions 4*c* are formed such that the recessed portions 4*c* are extended to both widthwise end peripheries of the control electrode 4 in FIG. 12A, as shown in FIG. 8A and FIG. 9A, it may be possible to leave slight peripheries at both end peripheries. Further, it is needless to say that the above-mentioned half-etched portions 4*b* formed on the control electrode 4 may be formed on both surfaces of the control electrode 4.

Figure 13A:
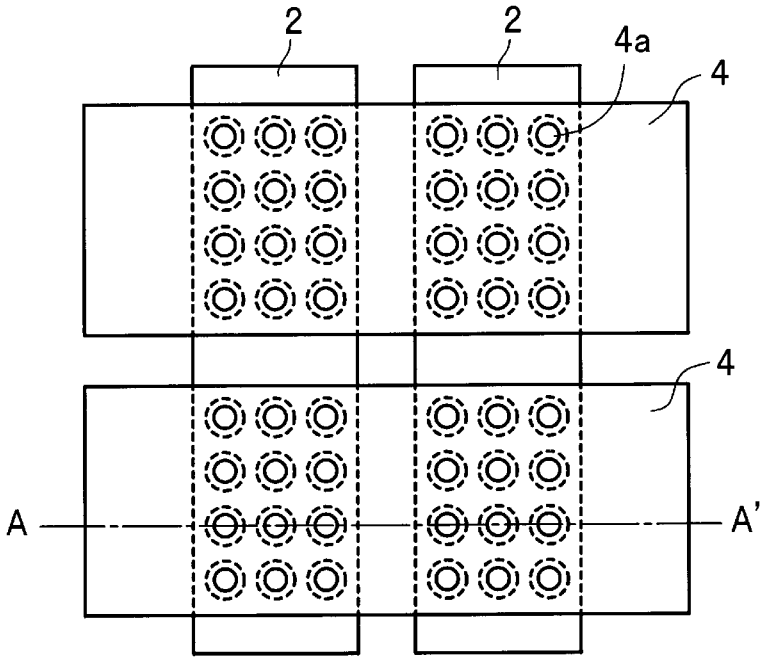
Figure 13B:
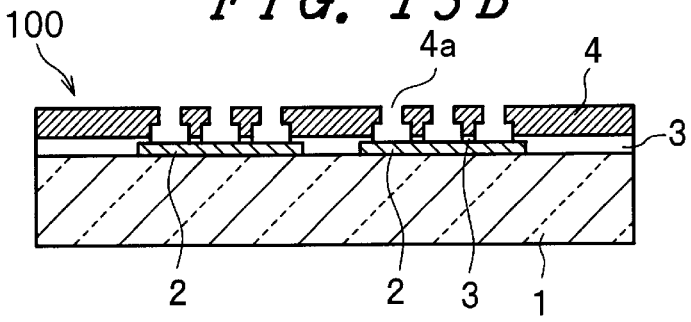
Figure 13C:
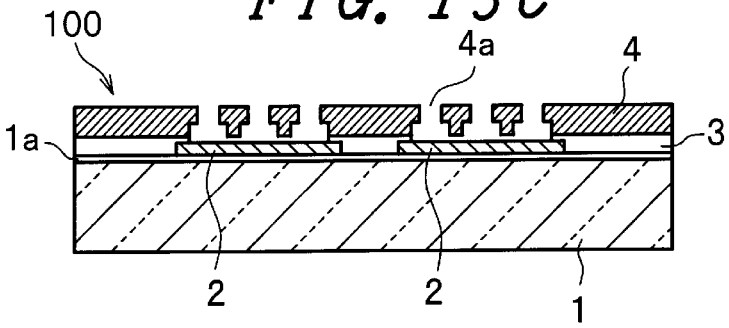

FIG. 13A to FIG. 13C are partial cross-sectional views for explaining control electrodes used in a ninth embodiment of the display device according to the present invention, wherein FIG. 13A is a plan view, FIG. 13B is a cross-sectional view taken along a line A–A' of FIG. 13A, and FIG. 13C is a cross-sectional view showing a modification of FIG. 13B. In this embodiment, holes 4*a* formed in each control electrode 4 for allowing electrons to pass therethrough have a stepped shape of two stages as viewed in cross-section. That is, as shown in these drawings, the hole 4*a* is formed in a large-diameter shape at a cathode wire 2 side and in a small-diameter shape at an anode side. Here, electron emitting sources 2*a* formed on the cathode wires 2 are omitted from the drawings.

These holes 4*a* are obtained, in the same manner as the formation of the holes 4*a* in the above-mentioned respective embodiments, by respectively coating a photo sensitive resist on both surfaces of the control electrode 4 and performing patterning and etching processing on the photosensitive resist to respective hole size. In FIG. 13B, an insulation layer 3 is interposed between the control electrodes 4 and a rear substrate 1 including spaces defined between peripheries formed between respective holes 4*a* and the cathode wires 2. On the other hand, in FIG. 13C, the insulation layer 3 is interposed between each portion defined between pixels (between the cathode wires 2) and the rear substrate 1 and the insulation layer 3 is not interposed between the peripheries formed between respective holes 4*a* and the cathode wires 2.

According to this embodiment, metal material having a large plate thickness can be used as the control electrode 4 so that it is possible to suppress the fluctuation of a gap between the holes 4*a* and the cathode wires 2 which may be generated when a tension is applied to the control electrode 4.

Figure 14:
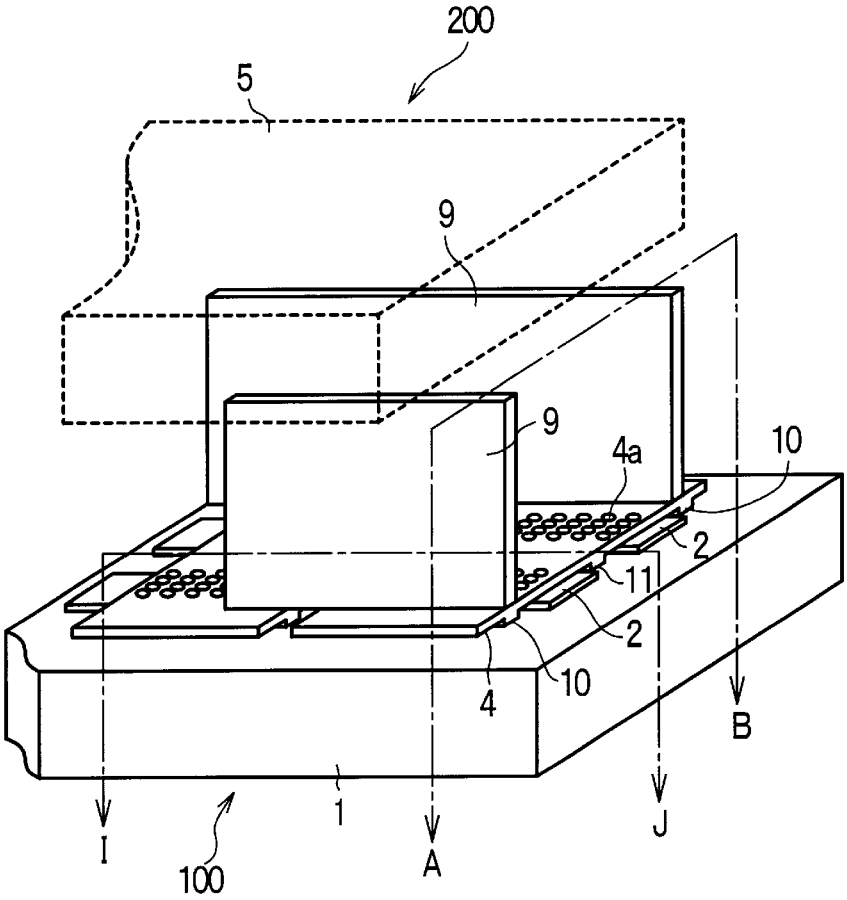
FIG. 14 is a perspective view for explaining a mounting structure of a gap holding member disposed between a rear panel and a face panel for explaining a tenth embodiment of the display device according to the present invention.
Figure 15:
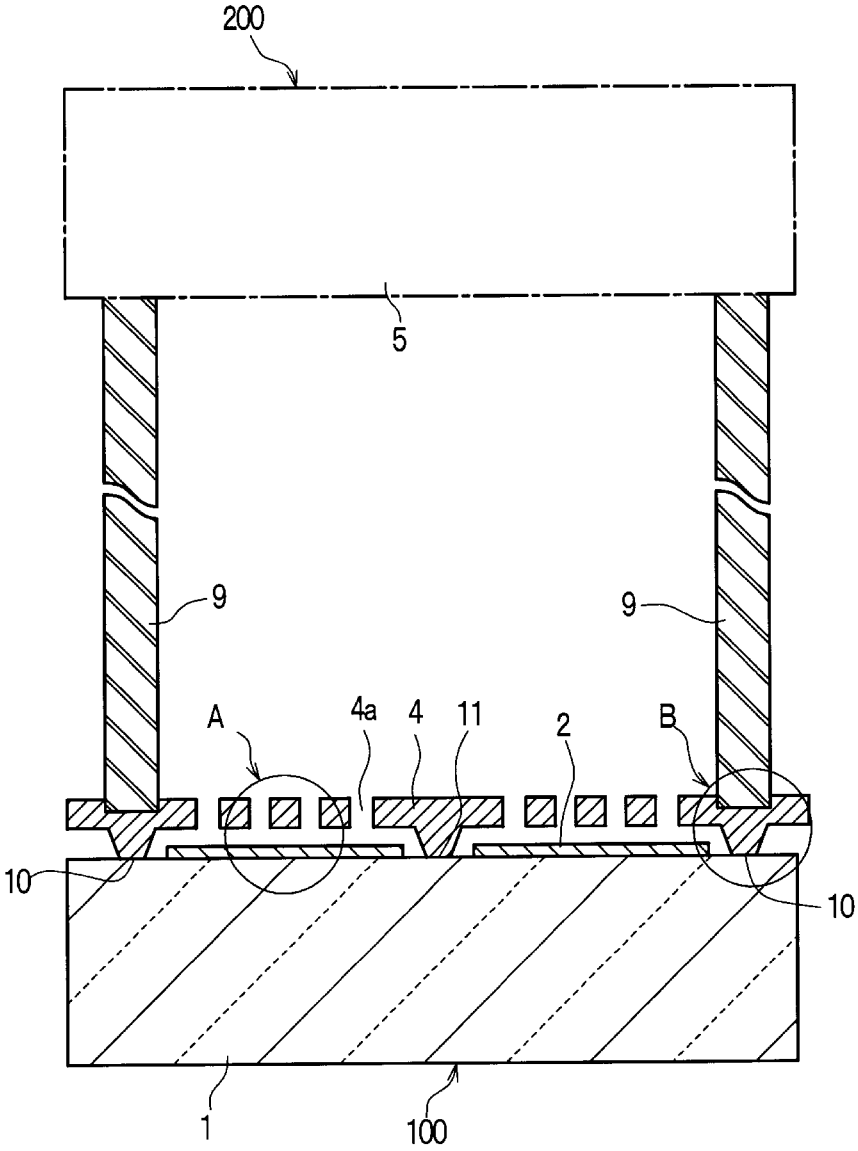
FIG. 15 is a cross-sectional view taken along a line A–B of FIG. 14.
Figure 16A:
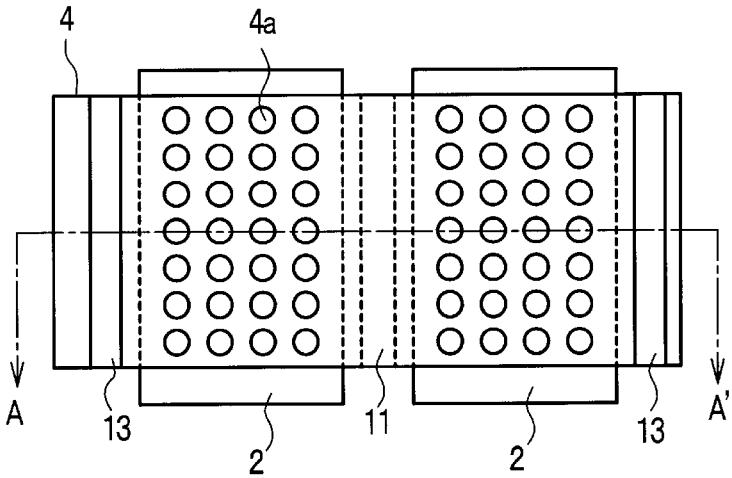
Figure 16B:
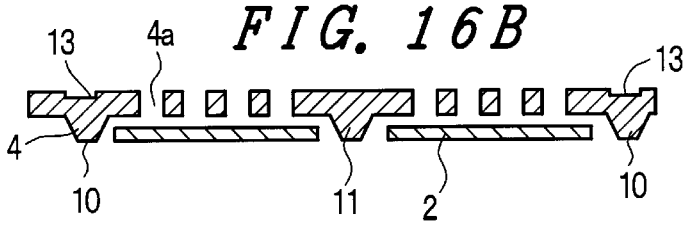

FIG. 14 is a perspective view for explaining a mounting structure of gap holding members provided between a rear panel and a face panel for explaining a tenth embodiment of the display device according to the present invention. FIG. 15 is a cross-sectional view taken along a line A–B of FIG. 14 and FIG. 16A to FIG. 16B are explanatory views of a structure of an essential part in FIG. 14, wherein FIG. 16A is a plan view as viewed from the I–J direction of FIG. 14 and FIG. 16B is a cross-sectional view taken along a line A–A' of FIG. 16A. In this embodiment, each control electrode 4 is constituted such that the control electrode 4 is formed of an iron plate or an alloy containing iron as a major component having a relatively large plate thickness and an insulation layer 3 is not interposed between the control electrode 4 and cathode wires 2.

That is, as shown in FIG. 14 to FIG. 16B, the control electrode 4 is mounted such that the control electrode 4 is floated spatially with respect to the cathode wires 2 which are formed on a rear substrate 1 constituting a rear panel 100. Although it is preferable to set the plate thickness of the control electrode 4 to approximately 10 $\mu$m to 500 $\mu$m, the plate thickness is not limited to such a value. Although electron emitting sources 2*a* formed of carbon nanotubes, carbon fibers or the like are formed on the cathode wires 2, they are omitted from the drawings.

On an inner surface of the rear substrate 1 which constitutes the rear panel 100, a plurality of cathode wires 2 and a plurality of control electrodes 4 are formed in an crossing manner and one pixel is formed at each crossing portion. The control electrode 4 has a plurality of holes 4*a* per one pixel and has a first contact portion 10 and a second contact portion 11 having a projection shape at the rear substrate 1 side at a portion thereof which is brought into contact with the rear substrate 1.

The first contact portion 10 and the second contact portion 11 are fixed to the rear substrate 1 directly or using a second adhesive 15 which will be explained later. Further, to a side of the control electrode 4 opposite to the first contact portion 10, a gap holding member 9 is fixed directly or using a first adhesive 14 not shown in the drawing. The first contact portion 10 and the second contact portion 11 are formed between a plurality of cathode wires 2 and the second contact portion 11 is formed at a portion where the gap holding member 9 is not present. With respect to the number of mounting of the gap holding members 9, since the gap holding members 9 are mounted among whole pixels or between arbitrary pixels, the number depends on the size and the like of the display device.

The rear substrate 1 may be formed of a metal plate which has a surface thereof covered with inorganic insulation material, glass, quartz or insulation material or the like. Although it is preferable to set a plate thickness of the rear substrate 1 to approximately 0.5 mm to 3 mm, the plate thickness is not limited to such a value.

Although an anode and a fluorescent material are formed on an inner surface of the face panel 200, they are omitted from the drawing. The gap holding members 9 which define a gap formed between the face panel 200 and the rear panel 100 which face each other in an opposed manner is formed of a metal plate which has a surface thereof covered with inorganic insulation material, glass, quartz or insulation material or the like.

Although the gap holding members 9 are formed of simple plate-like members which are referred to a so-called rib structure in this embodiment, members having various shapes such as members having a so-called cross-structure which is also provided with ribs in the different direction in a plan view can be used.

The spatial positional relationship between the control electrodes 4 and the cathode wires 2 which largely influences the driving characteristics of a display device of this kind can be realized by performing a precision machining of the control electrodes 4. When the control electrodes 4 are constituted of metal plates, holes 4*a* may be machined accurately by adopting etching based on a photolithography technique which uses a photosensitive resist.

The control electrodes 4 have portions of lower surfaces thereof brought into contact with the rear substrate 1 directly or by way of an adhesive and have portion of upper surfaces thereof brought into contact with the gap holding members 9 directly or by way of an adhesive. Here, it is possible to hold the gap holding members 9 on the control electrodes 4 by forming grooves 13 in the control electrodes 4 and fitting the gap holding members 9 in these grooves 13. As shown in FIG. 16A, holes 4*a* for allowing electrons to pass therethrough which are formed in the control electrode 4 are arranged in a quadratic array.

The gap holding members 9 have upper portions thereof brought into contact with the front substrate 5 directly or by way of an adhesive so that the gap holding members 9 can firmly support the rear panel 100 and the face panel 200 whereby the gap defined between the rear panel 100 and the face panel 200 which face each other in an opposed manner can be held at a given value with high accuracy against an atmospheric pressure applied to an external surface of the display device.

In the display device of this embodiment, since no insulation layer is interposed in a space defined between the cathode wires 2 and the control electrodes 4 and the space is evacuated, the capacitance between both electrodes is minimized. As a result, it is possible to input high-frequency control signals so that a display device having a large screen and a high definition can be easily realized.

Further, since the rear substrate 1 and the control electrodes 4 can be machined as separates parts, they can be assembled after fabricating them using optimum machining methods respectively whereby the productivity can be enhanced. For example, the control electrodes 4 are separately formed by etching or by laminating two or more members. The details of a portion A and a portion B shown in FIG. 15 are explained later.

Figure 17:
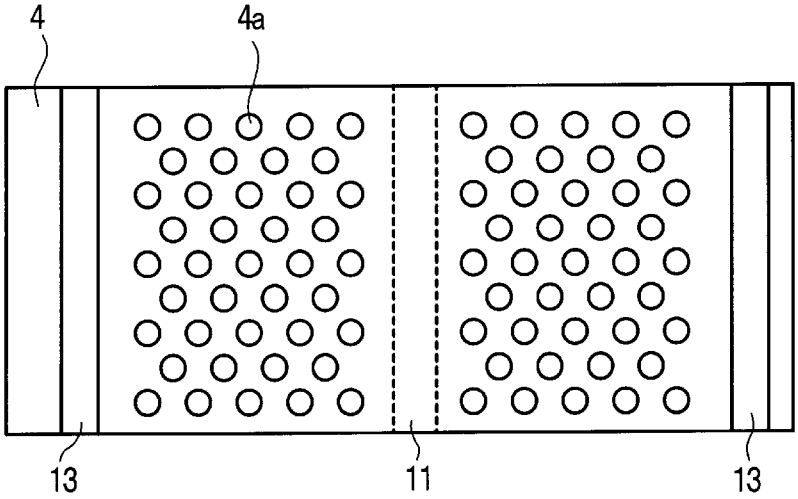
FIG. 17 is a plan view for explaining another shape of a control electrode used in the tenth embodiment of the display device according to the present invention shown in FIG. 14.

FIG. 17 is a plan view for explaining another shape of the control electrode 4 used in the tenth embodiment of the display device according to the present invention shown in FIG. 14. Although the hole 4*a* formed in the control electrodes 4 are arranged in a quadratic array in FIG. 16A, the holes 4*a* are arranged in a so-called delta array in the control electrode 4 shown in FIG. 17.

By forming the shape of the holes 4*a* in a circular shape in the same manner as FIG. 16A, the high machining accuracy and the high strength holding ability can be achieved. Further, by adopting the delta array in the arrangement of the holes 4*a* as shown in FIG. 17, the ratio of the whole hole area of a plurality of holes 4*a* with respect to the area of the control electrode 4, that is, the numerical aperture can be increased compared to the arrangement of holes shown in FIG. 16A so that the large electron emission ability can be obtained.

Figure 18:
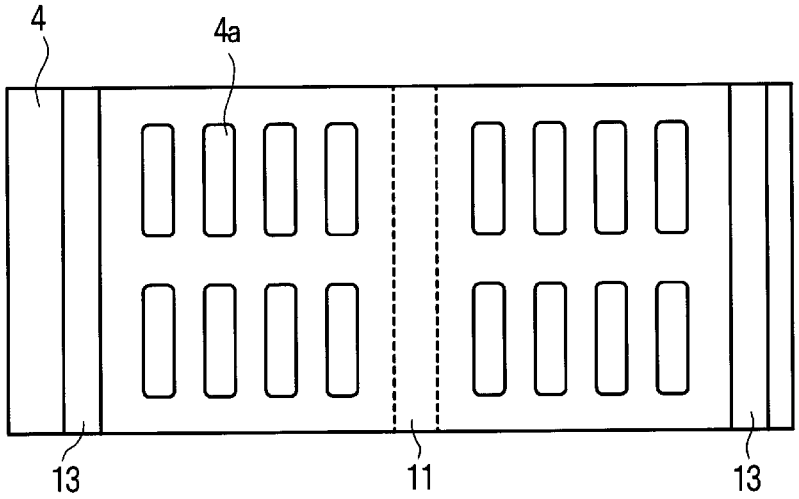
FIG. 18 is a plan view for explaining still another shape of a control electrode used in the tenth embodiment of the display device according to the present invention shown in FIG. 14.

FIG. 18 is a plan view showing still another shape of the control electrodes used in the tenth embodiment of the display device according to the present invention shown in FIG. 14. The holes 4*a* formed in the control electrode 4 have an approximately rectangular shape having a long axis in a direction which crosses the longitudinal direction of the control electrode 4 at a right angle. By forming holes 4*a* having such a shape, the numerical aperture can be further increased so that the larger electron emission ability can be achieved.

Figure 19:
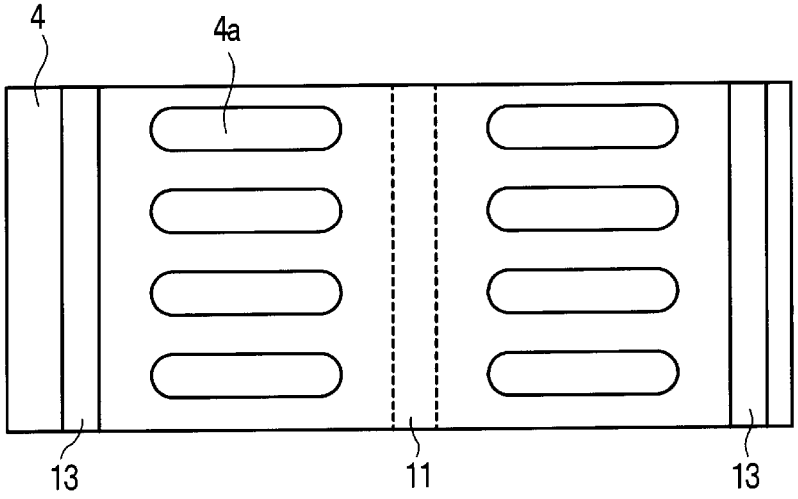
FIG. 19 is a plan view for explaining a further shape of a control electrode used in the tenth embodiment of the display device according to the present invention shown in FIG. 14.

FIG. 19 is a plan view for explaining a further shape of the control electrodes used in the tenth embodiment of the display device according to the present invention shown in FIG. 14. The holes 4*a* formed in the control electrode 4 have an approximately rectangular shape having a long axis in a direction parallel to the longitudinal direction of the control electrode 4. By forming holes 4*a* having such a shape, the numerical aperture can be further increased in the same manner as the control electrode 4 shown in FIG. 18 so that the larger electron emission ability can be achieved and, at the same time, the deformation of the opening holes 4*a* when the tension in the longitudinal direction is applied to the control electrode 4 can be reduced compared to the control electrode 4 shown in FIG. 18.

Figure 20:
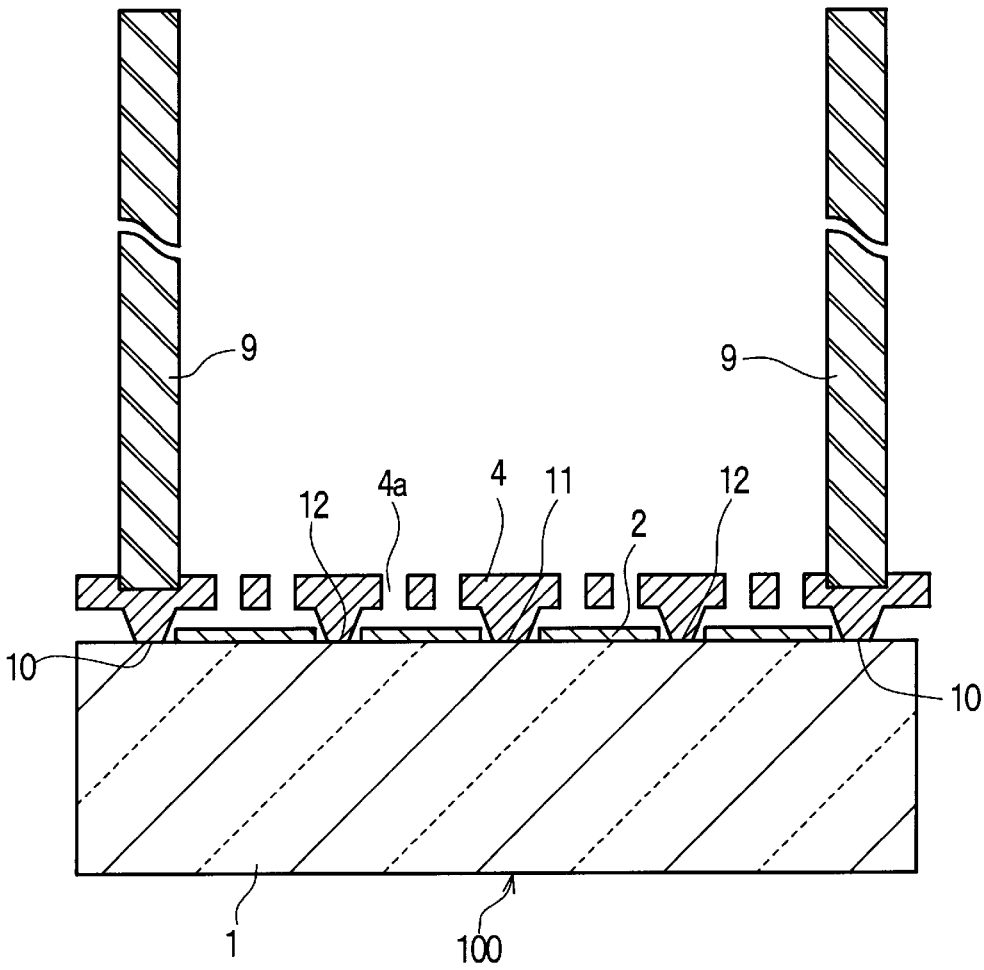
FIG. 20 is a cross-sectional view similar to FIG. 15 for explaining an eleventh embodiment of the display device according to the present invention.
Figure 21A:
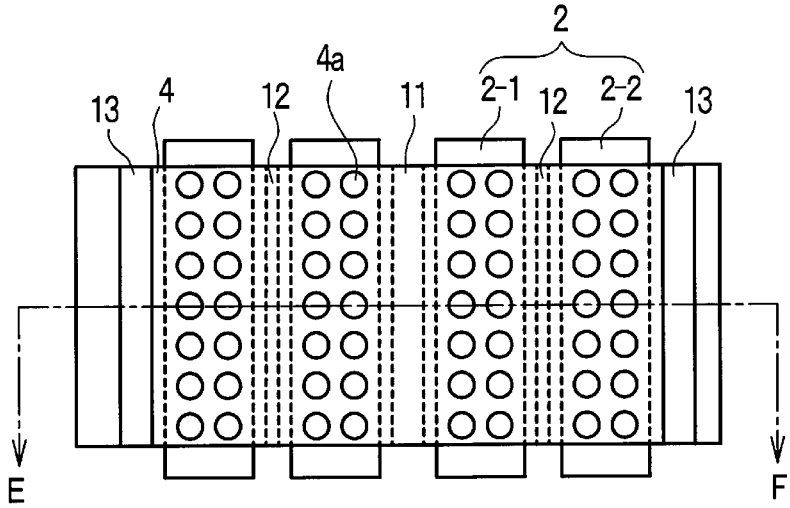
Figure 21B:
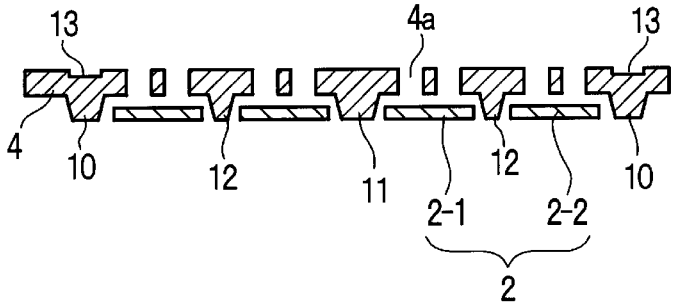

FIG. 20 is a cross-sectional view similar to that of FIG. 15 for explaining the mounting structure of gap holding members provided between a rear panel and a face panel for explaining an eleventh embodiment of the display device of the present invention. Further, FIG. 21A is a plan view of an essential part similar to that of FIG. 16A and FIG. 21B is a cross-sectional view taken along a line E–F of FIG. 21A. Here, the face panel 200 is omitted from the drawing.

In this embodiment, cathode wires 2 in one pixel are divided in halves, that is, a cathode wire 2-1 and a cathode wire 2-2 in the longitudinal direction and a third contact portion 12 of a control electrode 4 is positioned between the cathode wires 2-1, 2-2. Holes 4*a* formed in the control electrode 4 are formed such that they belong to pixel ranges of the respective cathode wires 2-1, 2-2 formed in halves.

In this embodiment, by bringing the control electrode 4 into contact with the rear substrate 1 at three contact portions, that is, first, second and third contact portions 10, 11, 12, a gap formed between both electrodes can be held with high accuracy. Here, although gap holding members 9 are provided at positions corresponding to both ends of the pixel, it is not always necessary to provide the gap holding members 9 for each pixel and, as mentioned previously, the gap holding members 9 may be provided for every several other pixels.

Figure 22A:
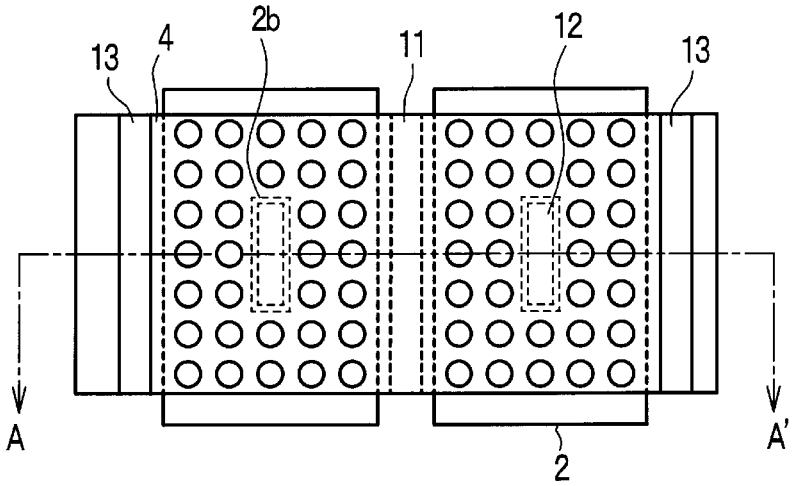
Figure 22B:
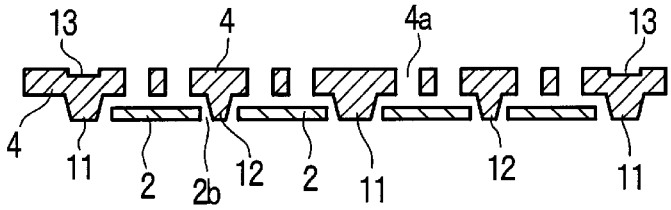

FIG. 22A and FIG. 22B are explanatory views of a twelfth embodiment of the display device according to the present invention, wherein FIG. 22A is a plan view of an essential part, FIG. 22B is a cross-sectional view taken along a line A–A' of FIG. 22A. In this embodiment, third contact portions 12 which are formed on a lower surface of a control electrode 4 are locally arranged in a pixel. By locally arranging the third contact portions 12 in the pixel compared to the tenth embodiment, contact portions between the control electrode 4 and a rear substrate 1 are increased so that a gap formed between the control electrode 4 and the rear substrate 1 can be set with high accuracy and, at the same time, the larger electron emission area can be achieved compared to the above-mentioned eleventh embodiment.

Figure 23:
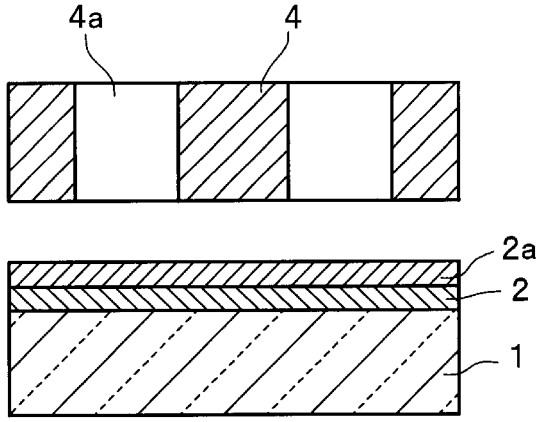
FIG. 23 is an explanatory view of one constitutional example of a portion surrounded by A in FIG. 15 of the tenth to the twelfth embodiments of the display device according to the present invention.

FIG. 23 is an explanatory view of one constitutional example of the portion surrounded by A in FIG. 15 showing the tenth to the twelfth embodiments of the display device of the present invention. Cathode wires 2 are formed by printing a paste containing conductive material preferably made of silver powder onto a rear substrate 1 and baking the paste. On the cathode wires 2, electron emitting sources 2*a* are formed by coating conductive material including ultra-fine needle-like material such as carbon nanotubes or carbon fibers on the cathode wires 2.

The electron emitting source 2*a* has a function of emitting electrons when an electric field is applied thereto. Holes 4*a* formed in the control electrode 4 fall within an area of the electron emitting source 2*a*. In this manner, by separately forming and laminating the cathode wire 2 and the electron emitting source 2*a* to each other, it is possible to select optimum materials to the cathode wire 2 and the electron emitting source 2*a* respectively.

Figure 24:
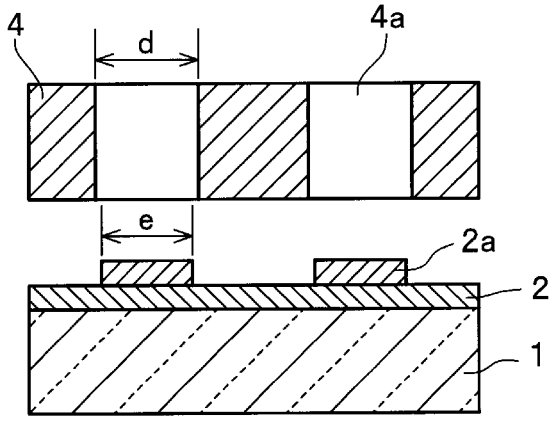
FIG. 24 is an explanatory view of another constitutional example of the portion surrounded by A in FIG. 15 of the tenth to the twelfth embodiments of the display device according to the present invention.

FIG. 24 is an explanatory view of another constitutional example of a portion which is surrounded by A in FIG. 15 in the tenth to the twelfth embodiments of the display device of the present invention. Here, the electron emitting sources 2*a* explained in conjunction with FIG. 23 are formed in ranges in which the electron emitting sources 2*a* fall within areas of holes 4*a* of a control electrode 4. Due to such a constitution, an undesired electron emission can be eliminated and expensive electron emitting source material can be saved.

To be more specific, by narrowing a size "e" of the electron emitting source 2*a* than a size "d" of the holes 4*a* in FIG. 24, the travelling disturbance of electrons derived from the sharp change of an electric field generated in the vicinity of end peripheries of the hole 4*a* can be suppressed so that the degradation of image quality due to the diffusion of undesired electrons can be prevented.

Figure 25:
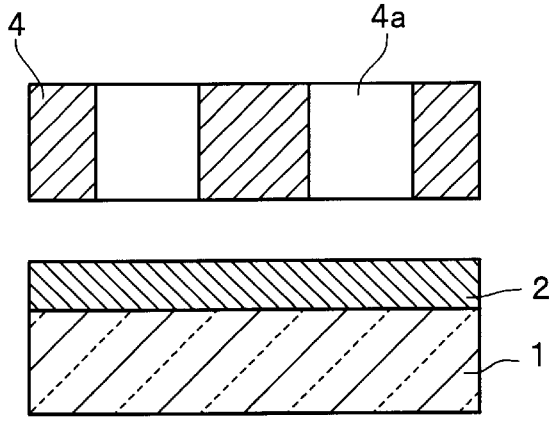
FIG. 25 is an explanatory view of still another constitutional example of the portion surrounded by A in FIG. 15 of the tenth to the twelfth embodiments of the display device according to the present invention.

FIG. 25 is an explanatory view of still another constitutional example of a portion which is surrounded by A in FIG. 15 in the tenth to the twelfth embodiments of the display device of the present invention. In this constitutional example, an electron emitting source is integrally formed with a cathode wire 2 such that the cathode wire 2 has a function of the cathode wire and a function of the electron emitting source. For example, a paste into which silver powdery particles and carbon nanotubes are mixed is printed on a rear substrate 1 to form the cathode wire 2. Due to such a constitution, the cathode wire 2 which exhibits low electric resistance and can obtain the sufficient electron emission can be formed so that it is possible to provide a display device which can facilitate the fabrication thereof and has a simplified structure.

Figure 26:
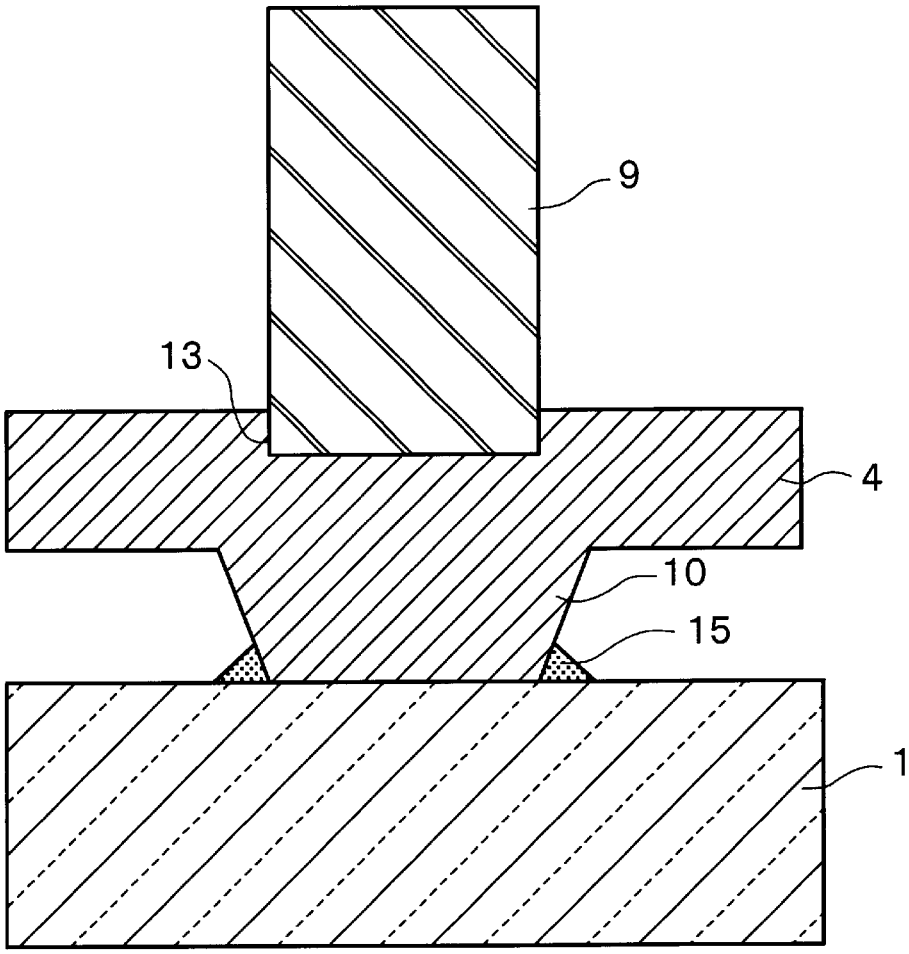
FIG. 26 is an explanatory view of another constitutional example of the portion surrounded by B in FIG. 15 of the tenth to the twelfth embodiments of the display device according to the present invention.

FIG. 26 is an explanatory view of still another constitutional example of a portion which is surrounded by B in FIG. 15 in the tenth to the twelfth embodiments of the display device of the present invention. A gap holding member 9 is arranged right above a first contact portion 10 of a control electrode 4 which brings the first contact portion 10 thereof into contact with a rear substrate 1. A groove 13 is formed in an upper surface of the control electrode 4 and the gap holding member 9 is fitted into the groove 13.

The control electrode 4 and the rear substrate 1 are fixed to each other using the second adhesive 15. In this manner, the control electrode 4 and the rear substrate 1 are firmly fixed to each other by means of the second adhesive 15 in the state that they are directly brought into contact with each other and hence, the rear substrate 1 and the control electrode 4, and eventually the gap holding member 9 are positioned accurately and, thereafter, their positions can be held.

Figure 27:
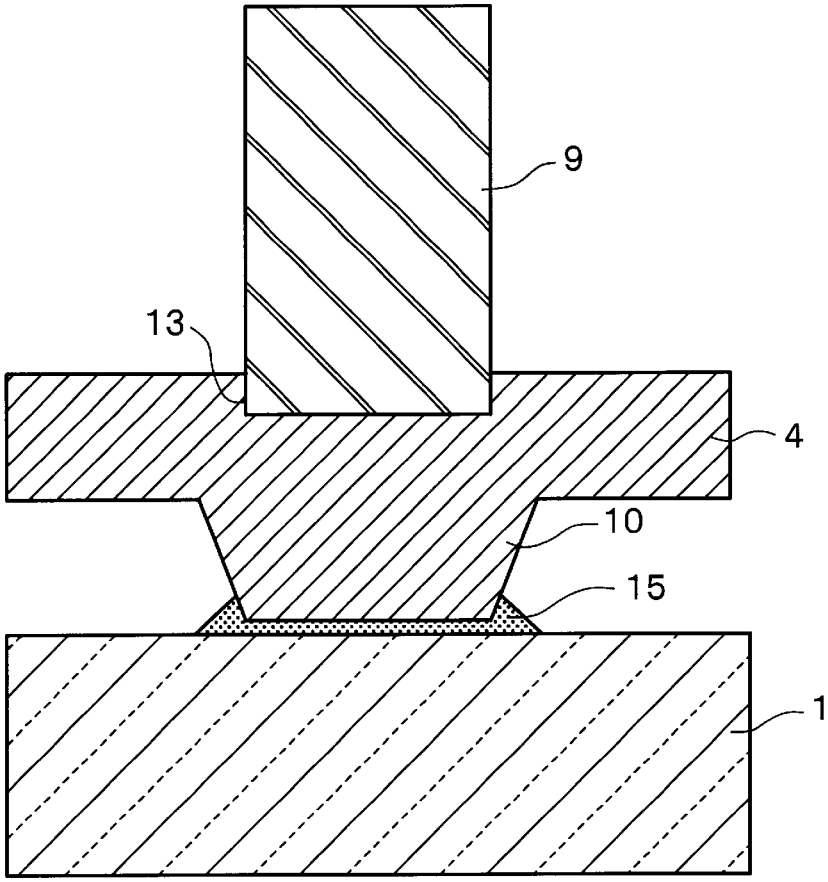
FIG. 27 is an explanatory view of still another constitutional example of the portion surrounded by B in FIG. 15 of the tenth to the twelfth embodiments of the display device according to the present invention.

FIG. 27 is an explanatory view of a further constitutional example of a portion which is surrounded by B in FIG. 15 in the tenth to the twelfth embodiments of the display device of the present invention. A gap holding member 9 is arranged right above a first contact portion 10 of a control electrode 4 which makes the first contact portion 10 thereof fixed to a rear substrate 1 by way of a second adhesive 15. A groove 13 is formed in an upper surface of the control electrode 4 and the gap holding member 9 is fitted into the groove 13.

The control electrode 4 and the rear substrate 1 are fixed to each other using the second adhesive 15. In this manner, the control electrode 4 is firmly fixed to the rear substrate 1 by means of the second adhesive 15 which is infiltrated between the rear substrate 1 and the first contact portion 10. Accordingly, even when the irregularities are present with respect to the gap between the rear substrate 1 and a plurality of first contact portions 10, the adhesive can absorb the irregularities and hence, the rear substrate 1 and the control electrode 4, and eventually the gap holding member 9 can be positioned accurately and, thereafter, their positions can be held.

Although the rear substrate 1 and the first contact portion 10 are brought into contact with each other in the above-mentioned respective embodiments, an insulation layer 3 may be interposed between them. Further, an anodic bonding technique can be used in place of the adhesive.

Figure 28:
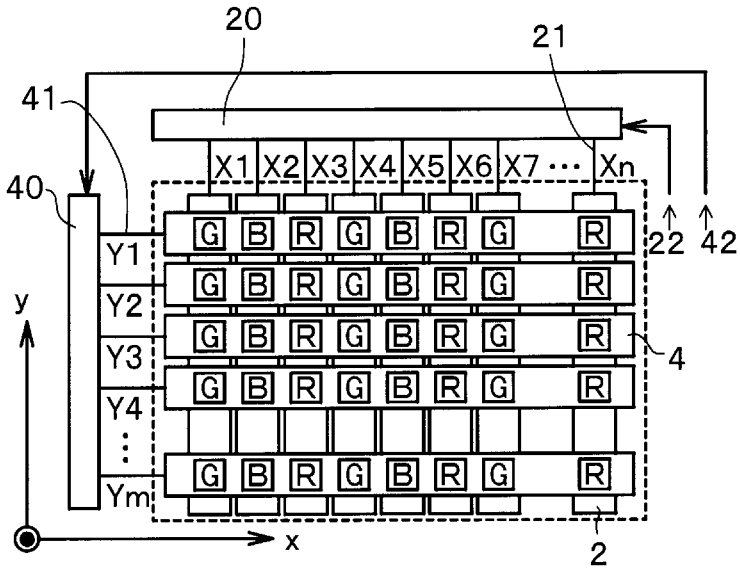
FIG. 28 is an equivalent circuit for explaining a driving method of the display device according to the present invention.
Figure 29:
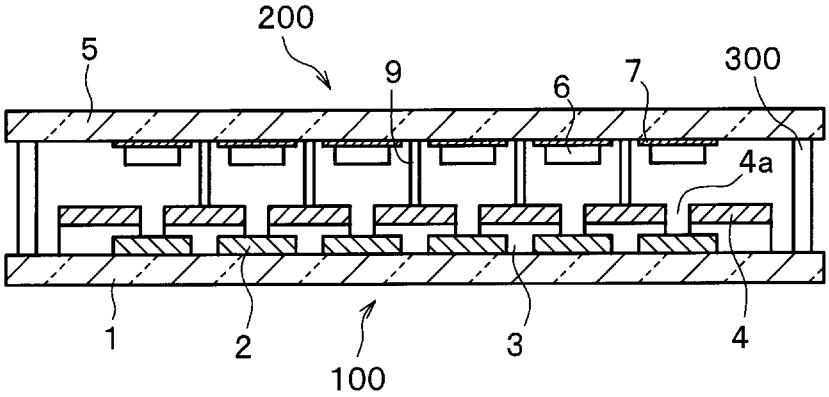
FIG. 29 PRIOR ART
FIG. 29 is a cross-sectional view for explaining one constitutional example of a known field emission type display device.
Figure 30A:
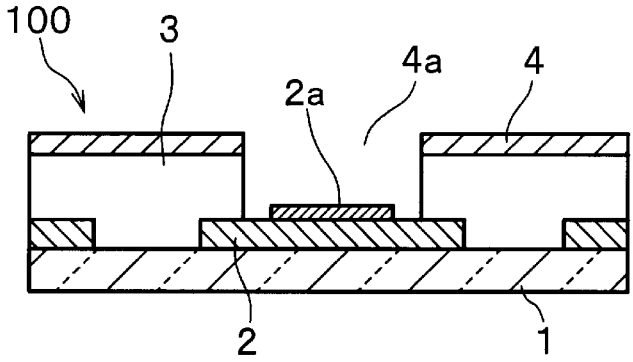
FIG. 30A PRIOR ART
FIG. 30A and FIG. 30B are explanatory views of a constitutional example of an electron emitting source and a control electrode which controls an electron emitting quantity from the electron emitting source per 1 pixel.
Figure 30B:
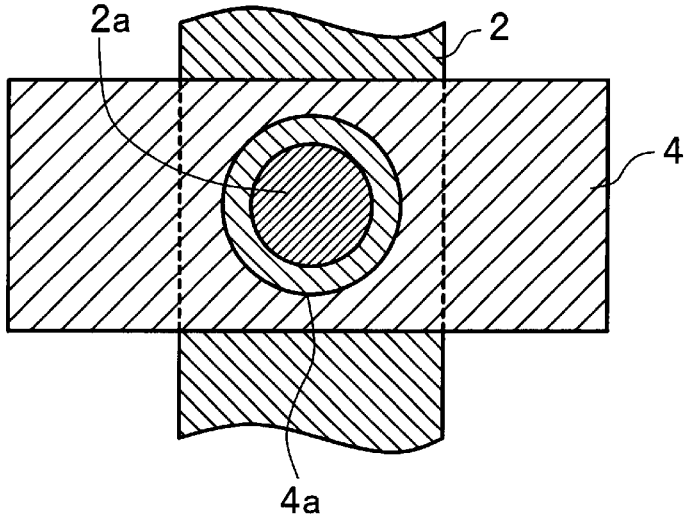
FIG. 30B PRIOR ART
Figure 31A:
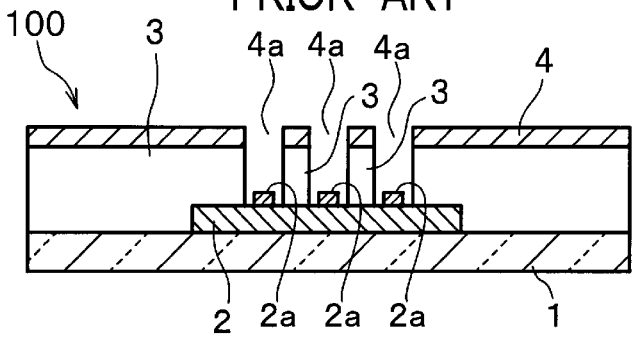
FIG. 31A PRIOR ART
FIG. 31A and FIG. 31B are explanatory views corresponding to FIG. 30A to FIG. 30B showing a display device in which a plurality of electron emitting sources are provided per 1 pixel.
Figure 31B:
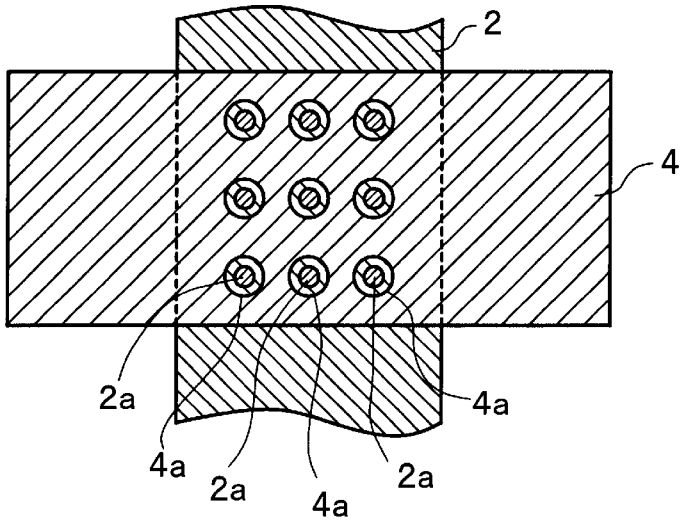
FIG. 31B PRIOR ART
Figure 32:
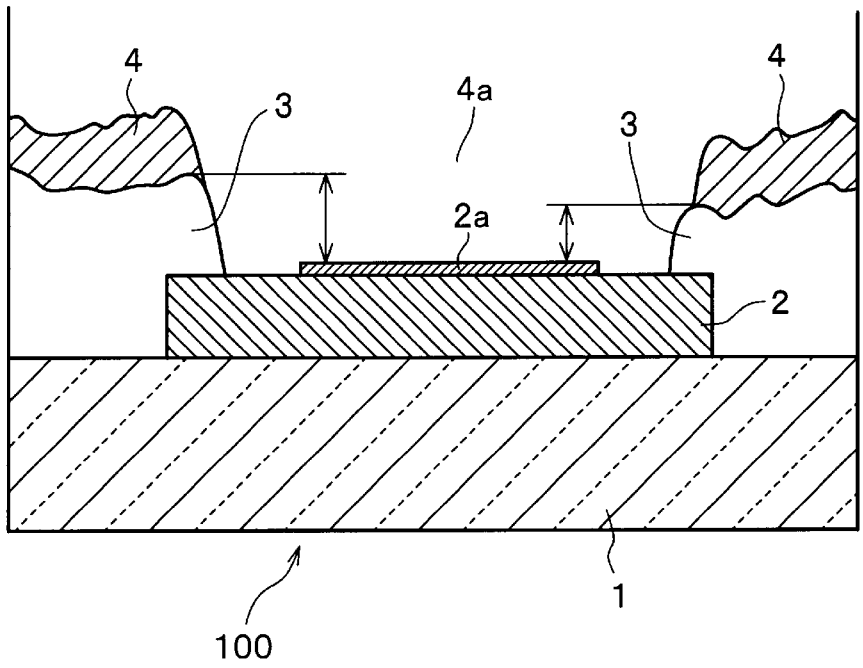
FIG. 32 PRIOR ART
FIG. 32 is an enlarged cross-sectional view of a pixel portion for explaining a constitutional example of a rear panel of a conventional field emission type display device.

FIG. 28 is an equivalent circuit for explaining a driving method of the display device according to the present invention. In this display device, n pieces of cathode wires 2 extending in the y direction are arranged in parallel in the x direction. Further, m pieces of control electrodes 4 extending in the x direction are arranged in parallel in the y direction thus constituting a matrix array of m rows and n columns together with the cathode wires 2.

On a periphery of a rear panel which constitutes the display device, a scanning circuit 40 and a video signal circuit 20 are arranged. Control electrode terminals 41 (Y1, Y2, . . . Ym) extending from the scanning circuit 40 are connected to the respective control electrodes 4 and cathode terminals 21 (X1, X2, . . . Xm) extending from the video signal circuit 20 are connected to the respective cathode wires 2.

The electron emitting source 2*a* which has been explained in the above-mentioned embodiments is provided to each one of pixels arranged in a matrix array. R, G, B in the drawing respectively correspond to the pixels of red, green and blue, and lights which correspond to respective colors are made to be emitted from fluorescent material.

Synchronous signals 42 are inputted to the scanning circuit 40. The scanning circuit 40 is connected to the control electrodes 41 through the control electrode terminals 41 and applies a scanning signal voltage to the control electrodes 4 by selecting the row of the matrix.

On the other hand, video signals 22 are inputted to the video signal circuit 20. The video signal circuit 20 is connected to the cathode wires 2 through the cathode terminals 21 (X1, X2, . . . Xn) and applies voltages to the cathode wires 2 by selecting rows of the matrix in response to the video signals 22. Accordingly, given pixels which are sequentially selected by the control electrodes 4 and the cathode wires 2 emit light with given colors thus displaying two-dimensional images. Due to the display device having the constitutional example of the present invention, a flat panel type display device which can be driven at a relatively low voltage and exhibits high efficiency can be realized.

As has been described heretofore, according to the present invention, the control electrodes 4 are formed of the plate-like members and are assembled to the rear substrate 1 and hence, the irregularities of the gap formed between the cathode wires 2 having the electron emitting sources 2*a* and the control electrodes 4 can be reduced and the insulation layers 3 interposed between the cathode wires 2 and the control electrodes 4 can be minimized or eliminated whereby the high-frequency driving is facilitated.

Further, by forming the holes 4*a* for allowing electrons to pass therethrough which are formed in the above-mentioned control electrodes 4 by etching and, at the same time, by forming recessed portions 4*c* for restricting the above-mentioned gaps or half-etched portions 4*b* which suppress the deformation of the holes 4*a* derived from the work strain or the tension in the holes 4*a*, it is possible to provide the display device which has the electron emission structure of high accuracy.

What is claimed is:

1. A display device comprising:

a rear panel having a plurality of cathode wires having electron emitting sources, a plurality of control electrodes which cross the cathode wires and control an emission quantity of electrons from the electron emitting sources in response to the potential difference between the cathode wires and the control electrodes and a rear substrate, and a face panel having anodes and fluorescent materials, wherein the control electrodes are formed of plate-like members, the control electrodes have holes which allow the electrons emitted from the electron emitting sources to pass therethrough toward the face panel side in first regions which cross the cathode wires, and assuming a distance from the rear substrate to the holes of the control electrodes as "a" and a distance from the rear substrate to the control electrodes as "b", the control electrodes have second regions where a relationship a>b is established between the neighboring cathode wires.

2. The display device according to claim 1, wherein the control electrodes are supported at the second regions.

3. The display device according to claim 1, wherein the control electrodes have recessed portions at the anode side in the first regions.

4. The display device according to claim 1, wherein an insulation layer is formed between the second regions and the rear substrate.

5. The display device according to claim 1, wherein the cathode wires are divided into two or more regions within one pixel and the control electrodes include the second region in each region defined between the divided cathode wires.

6. The display device according to claim 1, wherein the cathode wire includes an opening within one pixel and the control electrode has the second regions in the opening of the cathode wire.

7. The display device according to claim 1, wherein the control electrodes are fixed to the rear panel by an adhesive.

8. The display device according to claim 1, wherein the control electrode has the plurality of holes in one of the first regions.

9. The display device according to claim 8, wherein in one of the first regions, no insulation layer is provided between regions formed between the plurality of holes and the cathode wire.

10. A display device comprising:

a rear panel having a plurality of cathode wires having electron emitting sources, a plurality of control electrodes which cross the cathode wires and control an emission quantity of electrons from the electron emitting sources in response to the potential difference between the cathode wires and the control electrodes, and a rear substrate, and a face panel having anodes and fluorescent materials, wherein the control electrodes are formed of plate-like members, the control electrodes have third regions which are indented than other regions of the control electrodes in the thickness direction at positions where at least portions of the third regions are superposed on first regions where the control electrodes cross the cathode wires, and the control electrodes have holes which allow the electrons emitted from the electron emitting sources to pass therethrough toward the front panel side within the first regions and the third regions.

11. The display device according to claim 10, wherein assuming a distance from the rear substrate to the holes of the control electrodes as "a" and a distance from the rear substrate to the control electrodes as "b", the control electrodes have second regions where a relationship a>b is established between the neighboring cathode wires.

12. The display device according to claim 10, wherein, in the first regions, distances from the cathode wires to the first regions of the control electrodes are set substantially equal.

13. The display device according to claim 10, wherein an insulation layer is formed between the cathode wires and the control electrodes in the first regions.

14. The display device according to claim 10, wherein a thickness of widthwise end portions of the control electrodes is greater than a thickness of the holes in the first regions.

15. The display device according to claim 14, wherein the insulation layer is disposed between the cathode wires and the control electrodes at the widthwise end portions in the first regions.

16. The display device according to claim 10, wherein the control electrodes include the plurality of holes in one of the first regions.

17. The display device according to claim 10, wherein the third regions are formed by etching.

18. A display device comprising:

a rear panel having a plurality of cathode wires having electron emitting sources, a plurality of control electrodes which cross the cathode wires and control an emission quantity of electrons from the electron emitting sources in response to the potential difference between the cathode wires and the control electrodes, and a rear substrate, and a face panel having anodes and fluorescent materials, wherein the control electrodes are formed of plate-like members and include a plurality of holes per one of first regions thereof which cross the cathode wires, and in one of the first regions, no insulation layer is disposed between regions formed between the plurality of holes and the cathode wires, and the cathode wires have the electron emitting sources having an area smaller than an area of the holes corresponding to the holes.

19. A display device comprising:

a rear panel having a plurality of cathode wires having electron emitting sources, a plurality of control electrodes which cross the cathode wires and control an emission quantity of electrons from the electron emitting sources in response to the potential difference between the cathode wires and the control electrodes, and a rear substrate, and a face panel having anodes and fluorescent materials, wherein the control electrodes are formed of plate-like members, the control electrodes include holes in regions thereof which cross the cathode wires, the control electrodes include projecting portions between neighboring cathode wires, and the control electrodes are supported by the projecting portions.

* * * * *